US009460723B2

(12) United States Patent
Friedrich et al.

(10) Patent No.: US 9,460,723 B2
(45) Date of Patent: Oct. 4, 2016

(54) ERROR CONCEALMENT STRATEGY IN A DECODING SYSTEM

(71) Applicant: DOLBY INTERNATIONAL AB, Amsterdam Zuidoost (NL)

(72) Inventors: Tobias Friedrich, Nuremberg (DE); Tobias Ro Wagenblass, Nuremberg (DE); Karsten Linzmeier, Nuremberg (DE); Daniel Homm, Nuremberg (DE); Claus-Christian Spenger, Nuremberg (DE); Heiko Purnhagen, Sundbyberg (SE)

(73) Assignee: Dolby International AB, Amsterdam (NL)

( * ) Notice: Subject to any disclaimer, the term of this patent is extended or adjusted under 35 U.S.C. 154(b) by 95 days.

(21) Appl. No.: 14/406,351

(22) PCT Filed: Jun. 14, 2013

(86) PCT No.: PCT/EP2013/062342

§ 371 (c)(1),
(2) Date: Dec. 8, 2014

(87) PCT Pub. No.: WO2013/186345

PCT Pub. Date: Dec. 19, 2013

(65) Prior Publication Data

US 2015/0142451 A1 May 21, 2015

Related U.S. Application Data

(60) Provisional application No. 61/713,299, filed on Oct. 12, 2012, provisional application No. 61/659,602, filed on Jun. 14, 2012, provisional application No. 61/713,025, filed on Oct. 12, 2012.

(51) Int. Cl.
*G10L 19/00* (2013.01)
*G10L 19/008* (2013.01)
(Continued)

(52) U.S. Cl.
CPC ..... *G10L 19/0017* (2013.01); *G10L 19/005* (2013.01); *G10L 19/008* (2013.01); *G10L 19/22* (2013.01); *H04S 3/008* (2013.01)

(58) Field of Classification Search
CPC ..... G10L 19/008; G10L 19/26; H04S 3/008; H04S 7/30
USPC ..... 704/500; 381/119
See application file for complete search history.

(56) References Cited

U.S. PATENT DOCUMENTS 7,983,922 B2 * 7/2011 Neusinger ..... G10L 19/26 381/23
8,843,378 B2 * 9/2014 Herre ..... 704/500
(Continued)

FOREIGN PATENT DOCUMENTS

RS 1332 U 8/2013

OTHER PUBLICATIONS

Neuendorf, M. et al., "MPEG Unified Speech and Audio Coding—The ISO/MPEG Standard for High-Efficiency Audio Coding of All Content Typpes," AES Convention Paper 8654 Presented at the 132nd Convention, Apr. 26-29, 2012, pp. 1-22.
(Continued)

*Primary Examiner* — Daniel Abebe

(57) ABSTRACT

A decoding system reconstructs an audio signal based on an input signal representing the audio signal by parametric coding or by n discretely coded channels. Parametric decoding proceeds on the basis of a core signal and mixing parameters controlling a spatial synthesis stage, which is supplied with a downmix signal. A controller is responsible for controlling the components of the decoding system, whether in steady-state parametric mode, steady-state discrete decoding mode and transitions between these. In defective frames of the input signal, which do not allow the mixing parameters to be decoded, the controller is configured to perform various error handling procedures including: parametric decoding using previous values of the mixing parameters; continuing parametric decoding for a limited duration, and/or outputting the core signal without spatial synthesis.

8 Claims, 11 Drawing Sheets

(51) Int. Cl.

| | |
|---|---|
| ***G10L 19/22*** | (2013.01) |
| ***G10L 19/005*** | (2013.01) |
| *H04S 3/00* | (2006.01) |

(56) References Cited

U.S. PATENT DOCUMENTS

| | | | | |
|---|---|---|---|---|
| 2004/0170335 | A1* | 9/2004 | Pearlman | G06T 9/40 382/240 |
| 2005/0182996 | A1 | 8/2005 | Bruhn | |
| 2006/0004583 | A1* | 1/2006 | Herre | G10L 19/008 704/500 |
| 2008/0002842 | A1* | 1/2008 | Neusinger | G10L 19/26 381/119 |
| 2011/0129092 | A1 | 6/2011 | Virette | |

OTHER PUBLICATIONS

Anonymous, "Study on ISO/IEC 23033-3:201x/DIS of United Speech and Audio," IEEE, LIS, Sophia Antipolis Cedex, France, No. N12013, Apr. 23, 2011, pp. 1-274.

Stanojevic, T. et al., "The Total Surround Sound System," 86th AES Convention, Hamburg, Mar. 1989, pp. 1-21.

Stanojevic, T. et al., "Designing of TSS Halls," 13th ICCA, Belgrade, 1989, pp. 327-330.

Stanojevic, T. et al., "TSS System and Live Performance Sound," 88th AES Convention, Montreux, Mar. 1990, pp. 1-27.

Stanojevic, T. et al., "3-D Sound in the Future HDTV Projection Halls", 132nd SMPTE Technical Conference and Equipment Exhibit, New York, Oct. 1990, pp. 1-20.

Stanojevic, T. et al., "Some Technical Possibilities of Using the TSS Concept in the Motion Picture Technology", 133rd SMPTE Technical Conference and Equipment Exhibit, Los Angeles, Oct. 1991, pp. 1-3.

Stanojevic, T. et al., "TSS Processor", 135rd SMPTE Technical Conference and Equipment Exhibit, Los Angeles, Oct. 1993, pp. 1-22.

Stanojevic, T. et al., "Virtual Sound Sources in the Total Surround Sound System", 137th SMPTE Technical Conference and World Media Expo, New Orleans, Sep. 1995.

Stanojevic, T. et al., "The Total Surround Sound (TSS) Processor," SMPTE Journal, Nov. 1994, pp. 734-740.

Stanojevic, T., Surround Sound for a New Generation of Theaters, Sound & Video Contractor, Dec. 20, 1995, pp. 30-40.

ETSI: "ETSI TS 102 563 v1.2.1 Digital Audio Broadcasting (DAB); Transport of Advanced Audio Coding (AAC)", May 31, 2005, pp. 1-27.

Purnhagen, H. et al. "Error Protection and Concealment for HILN MPEG-4 Parametric Audio Coding", Proc. of the 110th Convention of the Audio Engineering Society, Amsterdam, The Netherlands, May 15, 2001.

* cited by examiner

ERROR CONCEALMENT STRATEGY IN A DECODING SYSTEM

CROSS-REFERENCE TO RELATED APPLICATIONS

This application claims priority to U.S. provisional patent application Nos. 61/713,299 filed 12 Oct. 2012; 61/713,025 filed 12 Oct. 2012 and 61/659,602 filed 14 Jun. 2012, which are hereby incorporated by reference in its entirety.

TECHNICAL FIELD

The invention disclosed herein generally relates to audio-visual media distribution. In particular it relates to an adaptive distribution format enabling a higher-bitrate and a lower-bitrate mode as well as seamless mode transitions during decoding. The invention further relates to methods and devices for encoding and decoding signals in accordance with the distribution format.

BACKGROUND

Parametric stereo and multichannel coding methods are known to be scalable and efficient in terms of listening quality, which makes them particularly attractive in low bitrate applications. In cases where the bitrate limitations are of a transitory nature (e.g., network jitter, load variations), however, the full benefit of the available network resources may be obtained through the use of an adaptive distribution format, wherein a relatively higher bitrate is used during normal conditions and a lower bitrate when the network functions poorly. Existing adaptive distribution formats and the associated (de)coding techniques may be improved from the point of view of their bandwidth efficiency, computational efficiency, error resilience, algorithmic delay and further, in audiovisual media distribution, as to how noticeable a bitrate switching event is to a person enjoying the decoded media. Error resilience, particularly robustness against data losses during streaming, is a main concern in this disclosure.

BRIEF DESCRIPTION OF THE DRAWINGS

Example embodiments of the invention will now be described with reference to the accompanying drawings, on which.

All the figures are schematic and generally only show parts which are necessary in order to elucidate the invention, whereas other parts may be omitted or merely suggested. Unless otherwise indicated, like reference numerals refer to like parts in different figures.

DESCRIPTION OF EXAMPLE EMBODIMENTS

I. Overview—Error Handling

Figure 1:
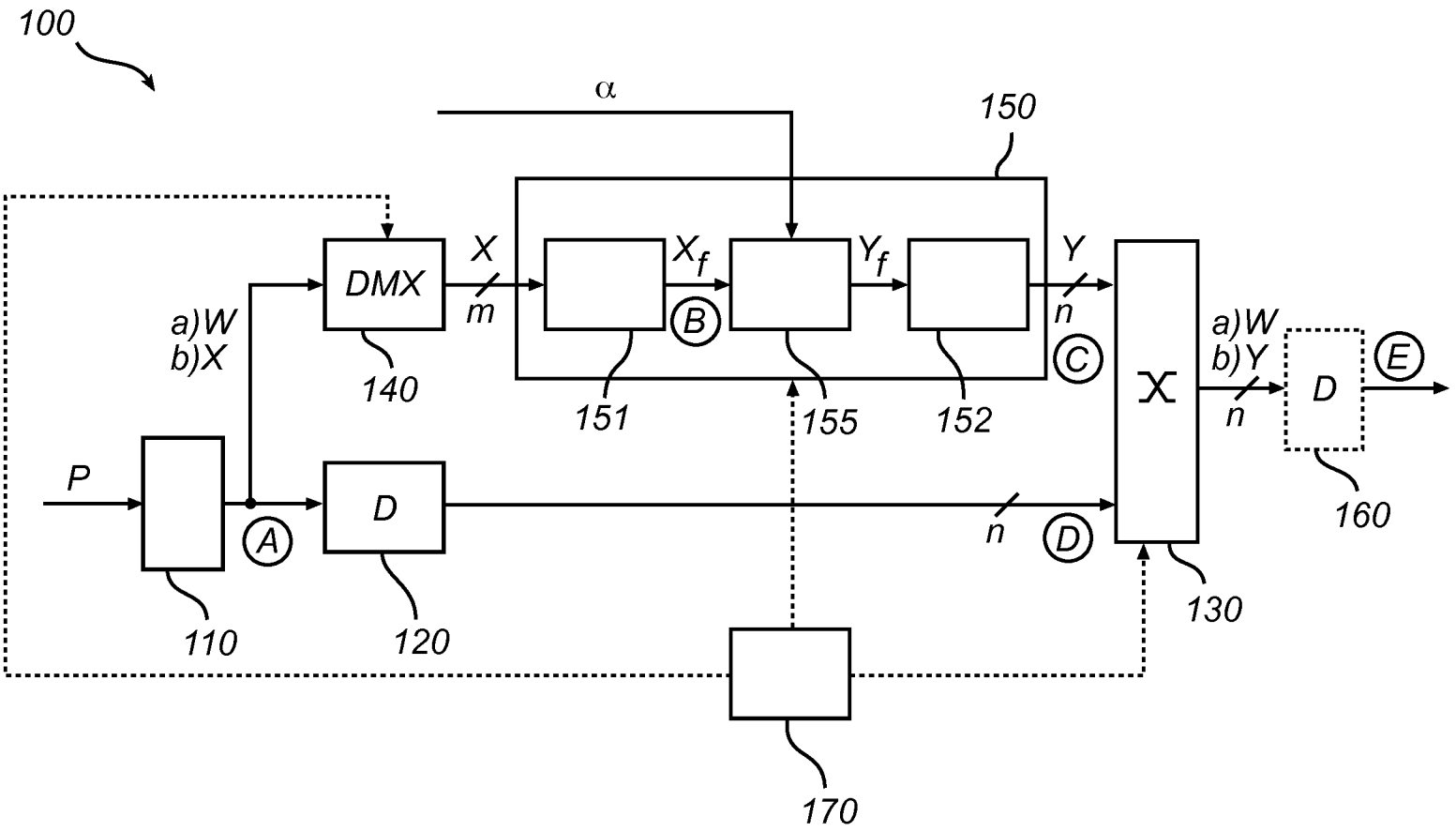
FIG. 1 is a generalized block diagram of a decoding system in accordance with an example embodiment of the invention.

As used herein, an audio signal may be a pure audio signal, an audio part of an audiovisual signal or multimedia signal or any of these in combination with metadata.

Example embodiments of the present invention proposes methods, devices and computer program products, with the features set forth in the independent claims, for reconstructing an n-channel audio signal based on an input signal.

In operation, a decoding system receives an input signal segmented into (overlapping or contiguous) time frames. Each non-defective time frame is in accordance with a coding regime selected from parametric coding or discrete coding. The characteristics of the coding regimes and the corresponding decoding modes (e.g., parametric mode and discrete mode) will be discussed in later sections of this application. As will also be further discussed, the decoding system may in some embodiments be adapted to receive time frames coded by a reduced parametric regime, which either replaces or supplements the regular parametric coding regime; this may optionally be reflected by a further mode of operation of the decoding system differing from the regular parametric mode mainly in that no separate downmixing of the input signal is necessary. It is understood that both parametrically and discretely coded frames may carry metadata identifying them as such. For instance, a frame may be in accordance with a legacy format (e.g., the Dolby Digital Plus format, or Enhanced AC-3) including a metadata container for carrying metadata, such as a parametric/discrete status flag and possibly one or more mixing parameters. As will also be explained in more detail below, the modes of the decoding system may lag behind the regimes of the input signal by a time period corresponding to one or more time frames.

The decoding system comprises a controller configured to control the mode of the decoding system on the basis of the current mode and the current received frame. In particular, the controller may be a finite state machine uniquely determining the mode, which the decoding system is to enter or in which the decoding system is to remain, on the basis of the current mode and the coding regime of the current received frame of the input signal. For instance, the controller may be configured to cause the decoding system to enter a mode that corresponds to the coding regime, i.e., a parametrically (discretely) coded frame of the input signal will cause the decoding system to enter, possibly with some delay, the parametric (discrete) mode. To decide on the mode, the controller may additionally take further input into account, such as the coding regime of one or more previous received frames of the input signal and/or the duration for which the decoding system has been in its current coding mode. The controller may be arranged to control the operation of the spatial synthesis stage and the mixer, if any, that is responsible for selecting the spatial synthesis output or a different signal as output. If the decoding system is configured to receive reduced parametrically encoded time frames, the controller may further be configured to activate or deactivate the downmix stage. These components of the decoding system will be discussed in detail below.

In one example embodiment, the decoding system is operable in a keep mode, in addition to said parametric and discrete modes. In the keep mode, the decoding system derives the audio signal by spatial synthesis (or upmix) based on m channels (which may be referred to collectively as the core signal, wherein $m<n$) from the current frame and being guided by the mixing parameter(s) from a previous frame. For instance, the keep mode may agree with the parametric mode of the decoding system, with the exception that the channels input to the spatial synthesis are taken from a different frame of the input signal than the mixing parameter(s); instead, the mixing parameter(s) may be taken from a frame preceding the current frame directly or arriving one, two or more frame positions earlier in the sequence. As stated, the channels underlying the spatial synthesis are preferably taken from the current received frame. If the current received frame comprises m channels, then all are used; if it contains more than m channels (e.g., n channels), these may be downmixed to m channels prior to the spatial synthesis; alternatively, the excess channels may be ignored or discarded so that the number of channels supplied to the spatial synthesis is m.

Still referring to this example embodiment, said controller is further configured to handle receipt of a defective frame by the following instruction:

A. If the decoding system is in the parametric mode and a defective frame is received, the decoding system enters the keep mode.

The decoding system may enter the keep mode immediately or after some delay, allowing it to transition more smoothly into the keep mode. As used herein, a defective frame of the input signal is a parametrically coded frame for which at least the one or more mixing parameters are missing, indicated (e.g., in metadata) as erroneous, not decodable or the like. A discretely coded frame may also classify as defective if metadata (e.g., its header) are missing or distorted. In a defective frame, the channels may be correct or erroneous; in particular, the keep mode may include spatial synthesis based on m reconstructed channels and guided by mixing parameters from a preceding frame of the input signal. Frames for which it is not possible to determine the coding regime and frames that were expected but never received (as evidenced by frame sequence numbers or the like) may also be handled as defective in the present method.

The present example embodiment provides error resilience because reconstruction of the n-channel audio signal may continue also in the case where a defective frame of the input signal is received.

In further example embodiments, the controller is further configured with one of the following instructions, allowing it to handle receipt of at least one further defective time frame of the input signal:

B. If the decoding system is in the keep mode and a defective frame is received, the decoding system remains in the keep mode.

C. If the decoding system has been in the keep mode for a predetermined maximum duration and a defective frame is received, the decoding system enters the discrete mode, otherwise remains in keep mode.

According to instruction C, the decoding system may respond to receipt of a defective frame by interrupting spatial synthesis and decoding the defective input frame discretely. If the defective frame is discretely coded, its n discretely encoded channels may be decodable or at least possible to reconstruct, so that the decoding system will output a signal with n channels. If the defective frame is parametrically coded, the discrete decoding of the frame will a priori yield an m-channel signal, which may in turn undergo subsequent processing in order to provide an n-channel output signal. For instance, the m-channel signal resulting from decoding may be padded with n−m empty signals. Alternatively, the remaining n−m signals may be filled with signals which are linearly dependent on the m signals. Further alternatively, an rechannel output audio signal may be created by spatial synthesis guided by default values of the mixing parameters, wherein said default values may be predefined in the decoding system.

To realize instruction C, moreover, the decoding system may further comprise a counter or timer configured to keep track of the duration for which the decoding system has operated in the keep mode in the present run. The predetermined maximum duration referred to in instruction C may be expressed as a number of frames (e.g., 16 frames) or in time units (e.g., 0.5 s). The predetermined maximum duration may be set by a system designer, in a deployment phase, or during use by a user or system administrator. A relatively longer maximum duration may be chosen if the mixing parameters are known to vary slowly over time in typical cases. A relatively shorter maximum duration may be chosen if the use of discrete decoding is not expected to degrade the output quality significantly. Routine experimentation, possibly including listening tests, may provide a maximum duration value suitable in a concrete use case.

It is finally noted that the mode transition into the discrete mode preferably occupies non-zero time to achieve smoothness and/or avoid interruptions in the audio content, wherein the functioning of the components of the decoding system during this mode transition will be described below with reference to FIGS. 6, 8 and 10, e.g. Advantageously, the mode transition into discrete mode may be initiated one time frame before the predefined maximum duration of the keep mode has been reached.

In a further example embodiment, which may be practised separately from the previous example embodiment or in combination therewith, the controller in the decoding system may further be configured with the following instruction:

D. If the decoding system is in the keep mode and receives a parametrically coded frame in which said at least one mixing parameter can be successfully decoded, the decoding system enters the parametric mode.

It is noted that some of the components which are active in the parametric mode may have a non-zero pass-through time for reasons of algorithmic delays, e.g., time-to-frequency transformation, real-to-complex conversion, hybrid analysis filtering. From system modes not involving spatial synthesis, therefore, a smooth transition into parametric mode may occupy a non-zero time duration, such as one or more time frames. However, because both the keep mode and the parametric mode involve spatial synthesis, the decoding system may enter the parametric mode at once.

A further example embodiment, which may again be practised separately or in combination with features from previously described example embodiments, is directed to the case where the parametric regime includes predictive coding of the mixing parameters. As such, the input signal may either represent the audio signal by an independent frame (or I-frame, denoted P(I)) or a predicted frame (or P-frame, denoted P(P)). A P-frame may express the mixing parameters time-differentially, e.g., in terms of "deltas" referring to the previous value of the mixing parameters. The mixing parameter(s) of an I-frame can be decoded independently from other frames, while decoding of a P-frame may require that a preceding I-frame has already been decoded; in a stateful (or memoryful) decoder, the decoding of the I-frame may influence or define the state of the decoder. In some implementations, each P-frame following an I-frame may imply an incremental update of the decoder state, so that decoding of a given P-frame requires access not only to the most recent I-frame but also to all P-frames received in the present run. In particular, each P-frame may express the mixing parameter(s) incrementally with respect to a previous value, which is received in absolute terms with each I-frame. In any of these cases, the presence of an I-frame remains necessary in order to begin an episode of the parametric regime. To account for this fact, the controller is configured with the following instruction:

E. If the decoding system is in the keep mode and a parametric P-frame is received, the decoding system behaves as if a defective frame had been received.

It has already been explained how defective frames received in the keep mode are handled; see instructions B or C above. It is noted that the counter or timer keeping track of the duration for which the decoding system has operated in the keep mode in the present run does so independently of the cause for entering the keep mode. Put differently, the counter or timer is incremented in an equivalent fashion for every time frame the decoding system spends in the keep mode, regardless of whether the decoding system was triggered to enter (or remain in) the keep mode by receipt of a defective frame or a parametric P-frame.

If it is considered acceptable to supply the spatial synthesis stage with approximate input values (the approximation relying on the hypothesis that the defective frame carried negligible or zero increments), instruction E may be replaced by an instruction to leave the keep mode and enter the parametric mode. This entails updating the "kept" mixing parameter(s) by the increments carried by the received parametric P-frame.

Still referring to the case where the parametric coding regime includes predictive coding, the controller may further be configured with the following instruction:

F. If the decoding system is in the discrete mode and a predicted frame is received, the decoding system derives the audio signal on the basis of said m channels without guidance by a mixing parameter of the type normally decodable from a parametrically coded frame.

Discrete decoding of the predicted frame will a priori yield an m-channel audio signal, and it has been explained above how an n-channel signal suitable for output may be provided on the basis of this.

Additionally or alternatively to the above, a further example embodiment includes having a controller executing the following instruction:

G. If the decoding system is in the keep mode and a discretely coded frame is received, the decoding system performs a mode transition into the discrete mode.

The mode transition into the discrete mode preferably occupies non-zero time to achieve smoothness and/or avoid interruptions in the audio content. The functioning of the components of the decoding system during this mode transition will be described below with reference to FIGS. 6, 8 and 10.

In example embodiments, the decoding system may comprise a downmix stage and a spatial synthesis stage with properties to be described in detail below. The spatial synthesis stage is preferably active throughout the parametric mode and the keep mode of the decoding system. The decoding system may further comprise a first delay line and a mixer connected to the respective downstream sides of the first delay line and the spatial synthesis stage. In connection with mode transitions of the decoding system, the mixer may carry out mixing (e.g., cross fade) between the respective signals. The first delay line may be operable to delay the signal by a duration corresponding to the total pass-through time in the downmix stage and the spatial synthesis stage or otherwise a duration causing the signals to arrive at the mixer in a synchronized fashion.

In a further aspect of the present invention, an example embodiment provides a method of reconstructing an n-channel audio signal using a multimodal decoding system. The multimodal decoding system may be operable in a discrete mode, a parametric mode and a keep mode with the properties outlined above. The method is characterized by a step of selecting a mode of the decoding system based on the current mode and the coding regime of a current received frame, wherein the selection process may include instruction A above.

In further example embodiments, the method may include one or more of instructions B, C, D, E, F and G.

In a further aspect of the invention, there is provided a computer program product for performing the reconstruction method referred to above by means of a programmable computer.

Whether referring to systems, methods or computer programs, the preferable number n of channels in the audio signals is 6, wherein 5.1 stereo format may be used. The preferable number m of channels on which to base the spatial synthesis is 2, wherein the core signal may be encoded in 2.0 stereo format.

Further example embodiments are defined in the dependent claims. It is noted that the invention relates to all combinations of features, even if recited in mutually different claims.

II. Overview—Switching Behaviour and Mode Transitions

Within a first additional aspect of the present invention, an example embodiment proposes methods and devices enabling adaptive distribution of media content, such as audio or video content, with improved bitrate selection abilities and/or reduced delay. An example embodiment further provides a coding format suitable for such adaptive media distribution, which contributes to seamless transitions between bitrates.

Example embodiments of the invention provide an encoding method, encoding system, decoding method, decoding system, audio distribution system, and computer-program product with the features set forth in the independent claims.

A decoding system is adapted to reconstruct an audio signal on the basis of an input signal, which may be provided to the decoding system directly or may alternatively be encoded by a bitstream received by the decoding system. The input signal is segmented into time frames corresponding to (overlapping or contiguous) time segments of the audio signal. One time frame of the input signal represents a time segment of the audio signal according to a coding regime selected from a group of coding regimes including parametric coding and discrete coding. In particular, if the encoded audio signal is an n-channel signal, the input signal contains (at least) an equal number of channels in received frames where it is discretely coded, i.e., in the discrete coding regime, n discretely encoded channels are used to represent the audio signal. In parametrically coded received frames, the input signal comprises fewer than n channels (although it may be in n-channel format, with some channels unused) but may in addition include metadata, such as at least one mixing parameter derived from the audio signal during an encoding process, e.g., by computing signal energy values or correlation coefficients. Alternatively, the at least one mixing parameter may be supplied to the decoding system through a different communication path, e.g., via a metadata bitstream separate from the bitstream carrying the input signal. As noted, the input signal may be in at least two different regimes (i.e., parametric coding or discrete coding), to which the decoding system reacts by transitioning to—or remaining in—a parametric mode or a discrete mode. The transition of the system may have finite time duration, so that the decoding system enters the mode occasioned by the current coding regime of the input signal only after one or more time frames have elapsed. In operation, therefore, the modes of the decoding system may lag behind the regimes of the input signal by a period corresponding to one or more time frames. An episode of parametrically coded time frames refers to a sequence of one or more consecutive time frames all representing the audio signal by parametric coding. Similarly, an episode of discretely coded time frames is a sequence of one or more consecutive time frames with n discretely coded channels. As used herein, a decoding system is in a parametric mode in those time frames in which the decoding system output is produced by spatial synthesis (regardless of the origin of the underlying data) for the greater part of the frame duration; the discrete mode refers to any time frames in which the decoding system is not in the parametric mode.

The decoding system comprises a downmix stage adapted to output an m-channel downmix signal based on the input signal. Preferably, the decoding system accepts a downmix specification controlling quantitative and/or qualitative aspects of the downmix operations, e.g., gains to be applied in any linear combinations formed by the downmix stage. Preferably, the downmix specification is a data structure susceptible of being provided from a data communication or storage medium to at least one further downmix stage, e.g., a downmix stage with similar or different structural characteristics in an encoder providing the input signal, or a bitstream encoding the input signal, to the decoding system. This way, it may be ensured that these downmix stages are functionally equivalent, e.g., they provide identical downmix signals in response to identical input signals. The loading of a downmix specification may amount to a reconfiguration of the downmix stage after deployment, but may alternatively be performed during its manufacture, initial programming, installation, deployment or the like. The downmix specification may be expressed in terms of a particular form or format of the input signal (including positions or numbering of channels in a format). Alternatively, it may be expressed semantically (including a channel's geometric significance, irrespective of its position relative to a format). Preferably, the downmix specification is formulated independently of the current form or format of the input signal and/or the regime of the input signal, so that the downmix operation may continue past a change of input signal format without interruption.

The decoding system further comprises a spatial synthesis stage adapted to receive the downmix signal and to output an n-channel representation of the audio signal. The spatial synthesis stage is associated with a non-zero pass-through time for reasons of its algorithmic delay; one of the problems underlying the invention is to achieve smooth switching despite the presence of this delay. The n-channel representation of the audio signal may be output as the decoding system output; alternatively, it undergoes additional processing with the general aim of reconstructing the audio signal more faithfully and/or with fewer artefacts and errors. The spatial synthesis stage accepts at least one mixing parameter controlling quantitative and/or qualitative aspects of the spatial synthesis operation. In principle, the spatial synthesis stage is active in at least the parametric mode, e.g., when a downmix signal is available. In the discrete mode, the decoding system derives the output signal from the input signal by decoding each of the n discretely encoded channels.

According to this example embodiment, the downmix stage is active in at least the first time frame (e.g., throughout the entire frame) in each episode of discretely coded time frames and in at least the first time frame (e.g., throughout the entire frame) after each episode of discretely coded time frames. This implies that the m-channel downmix signal may be available as soon as there is a transition in the input signal from discrete to parametric coding. As a consequence, the spatial synthesis stage can be activated in shorter time, even if it includes processing associated with an intrinsic non-zero algorithmic delay, e.g., time-to-frequency transformation, real-to-complex conversion, and/or hybrid analysis filtering. Further, an n-channel representation of the audio signal may stay available throughout transitions from parametric mode to discrete mode and may be used to make such transitions faster and/or less noticeable.

As used herein, a time frame (or frame) is the smallest unit of the input signal for which the coding regime can be controlled. Preferably, non-empty channels of the input signal are obtained by a windowed transform. E.g., each transform window may be associated with a sample and consecutive transform windows may overlap, as in MDCT. Clearly, if consecutive windows overlap by 50%, the length of a time frame is not smaller than the half-length of a transform window (e.g., the half-length of a 512-sample transform window is equivalent to 256 samples), which is then equal to the transform stride. Because the switching events can be made less perceptible to a person enjoying the decoded audio, this example embodiment need not limit the number of switching events during operation, but may respond attentively to changes in network conditions. This permits available network resources to be utilized more fully. A reduced decoding system delay may enhance the fidelity of the media, particularly in live media streaming.

For the purposes of this disclosure, by the downmix stage being active in a time frame, it is meant that the downmix stage is active at least during a subset of the time frame. The downmix stage may be active throughout/during an entire frame or only during a subset of the time frame, such as the initial portion of the frames. The initial portion may correspond to ½, ⅓, ¼, ⅙ of the frame length; the initial portion may correspond to the transform stride; alternatively, the initial portion may correspond to T/p, where T is the frame length and p is the number of transform windows that begin in each frame. A transition between coding regimes in the input signal typically involves a cross-fade in the beginning of a time frame (e.g., during the first ⅙ of the time frame or during 256 time samples out of 1536), between the coding of the previous time frame and the coding of the current time frame (e.g. as a result of using overlapping transform windows when transforming the input signal from a frequency-domain format in which it may be obtained from a bitstream, into the time-domain). The downmix stage may preferably be active during at least the initial portion of the time frame directly after a transition to or from discrete coding of the input signal. This makes the downmix signal available during the cross-fade in the input signal, whereby the spatial synthesis stage may output an n-channel representation of the audio signal for portions of time frames associated with cross-fade in the input signal. Information about the current regime of the input signal (e.g., parametric coding or discrete coding) may be received together with the input signal, e.g., a bit at a certain position in a bitstream in which the input signal is contained. For example, during parametric coding, information about spatial parameters may be found in certain positions of the bitstream while during discrete coding these positions/bits are not used. By checking the presence of such bits in their expected positions, the decoding system may determine the current coding regime of the input signal.

In a further development of the preceding example embodiment, a time segment of the input signal may represent a time segment of the audio signal by a coding regime selected from a group of coding regimes including parametric coding, discrete coding and reduced parametric coding. Thus, in the further development, there is an additional coding regime referred to as reduced parametric coding, in which the input signal is an m-channel core signal (possibly accompanied by mixing parameters and other metadata). This core signal is obtainable from a hypothetical discrete n-channel input signal representing the same audio signal (i.e., representing an audio signal which is identical to the audio signal first referred to) by means of downmixing in accordance with the downmix specification. Conversely, based on the input signal in discretely coded time frames, the downmix specification enables to determine what the core signal would have been if reduced parametric coding had been used to represent the same audio signal in those frames.

In frames where the input signal represents the audio signal by reduced parametric coding, there may be no need for performing any downmix. Indeed, the input signal is an m-channel core signal and need not be downmixed before it is sent to the spatial synthesis stage. Hence, the spatial synthesis stage may preferably receive the input signal directly, or the input signal may pass through the downmix stage unaffected before reaching the spatial synthesis stage. In frames where the input signal represents the audio signal by reduced parametric coding, the spatial synthesis stage may therefore output an n-channel representation of the audio signal based on the input signal and at least one mixing parameter. Deactivating the downmix stage (or putting it in idle/passive/rest mode) when receiving reduced parametrically coded time frames, may save energy whereby e.g., battery time in a portable device may be extended.

In an example embodiment, the downmix stage is active in each time frame in which the input signal represents the audio signal by parametric coding. In examples where there are only two coding regimes (parametric and discrete), this implies that the downmix stage is active in at least all frames which are not discretely coded. In examples where there are additional coding regimes available, such as reduced parametric coding, the downmix stage may be inactive/deactivated/idle also in time frames which are not discretely coded. This may save energy and/or extend battery time.

In an example embodiment, the decoding system is adapted to receive an input signal which during parametrically coded time frames comprises an m-channel core signal (in addition to any mixing parameters and other metadata). The core signal is obtainable from a hypothetical discrete n-channel input signal representing the same audio signal (i.e., representing an audio signal which is identical to the audio signal first referred to) by means of downmixing in accordance with the downmix specification. Conversely, based on the input signal in discretely coded time frames, the downmix specification enables to determine what the core signal would have been if parametric coding had been used to represent the same audio signal in those frames.

However, because the downmix stage is active in at least some discretely coded time frames (such as the first time frame in an episode of discretely coded time frames) where the input signal may not contain a core signal, the decoding system will be able to predict what this core signal would have been in these discretely coded time frames. Hence, even if there in principle may be no coexistence of a core signal and discretely coded channels, any discontinuities in connection with a regime change (between parametric coding, or reduced parametric coding, and discrete coding) in the input signal may be mitigated or avoided altogether.

In a further development of the preceding example embodiment, the downmix stage is adapted to generate the downmix signal by reproducing the core signal in the input signal if this is available. In other words, the downmix stage is adapted to respond to receipt of a parametrically coded time frame, inter alia, by copying or forwarding the core signal, so that the downmix stage outputs the core signal as the downmix signal. Put differently, if the m channels in the downmix signal are considered as a subspace of the space of n-channel input signals, then the downmix stage is a projection on this subspace. In particular, there is an m-channel subset of the input signal which the downmix stage maps identically to the respective m channels in the downmix signal. This may be stipulated in the downmix specification. For discretely coded time frames, the downmix signal is generated on the basis of the input signal and in accordance with the downmix specification. As discussed above, the downmix specification defines a relationship between the core signal and the n discretely coded channels in the input signal. This implies that a regime change in the input signal cannot in itself give rise to a discontinuity; that is, if the audio signal is continuous across the mode change, the downmix stage output will remain continuous and substantially free from interruptions.

In an example embodiment, which may be effected as an alternative to the example embodiments outlined above or as a further development of these, the decoding system is adapted to receive a bitstream encoding the input signal in a format applicable both in the parametric coding regime and the discrete coding regime. To accommodate the n discretely coded channels, the received bitstream encodes the input signal in a format including n channels or more. As a consequence, time frames in parametric coding regime may contain for example n−m non-used channels. To preserve the uniformity of the format in the parametric coding regime, the non-used channels are present but are set to a neutral value corresponding to no excitation, e.g., a sequence of zeros. The inventors have realized that a decoder product may contain legacy components or generic components (e.g., hardware, algorithms, software libraries) designed without an intention to be deployed in adaptive media distribution equipment, where format changes may be frequent. Such components may respond to a detected change into a lower-bitrate format by deactivating or partially powering themselves off. This may prevent smooth transitions between bitrates or make those more difficult to achieve due to discontinuities in connection with format changes, when the components revert to normal operation. Difficulties may also arise when contributions from frames in different coding regimes are summed, such as in connection with a transform with overlapping window functions. In the present example embodiment, because a uniform format is used for the input format, components with these characteristics in the decoding system will typically remain substantially unaffected by a transition from the parametric to the discrete coding regime and vice versa. The above holds true for all discretely or parametrically coded time frames. In some example embodiments, the input signal may instead be provided in m-channel format (reduced parametric coding regime) between two episodes of parametrically coded time frames, so as to remove a need for downmixing when no mode transition is imminent or being carried out. Optionally, an m-channel format (i.e. reduced parametric coding regime) may be used in all frames not discretely coded, and the decoding system may optionally be adapted to reformat the received m-channel format into n-channel format in at least some frames. For example, in reduced parametrically coded frames directly preceding, or directly succeeding discretely coded time frames, the reduced parametric coding may be reformatted by appending n−m neutral channels to the m-channel format, in order to obtain at least some of the above described advantages of having the same number of channels during transitions between different coding regimes. Preferably, the uniform format accommodates mixing parameters and other metadata for use in the parametric and/or discrete mode. Preferably, the input signal is encoded by entropy coding or similar approaches, so that the non-used channels will increase the required bandwidth only to a limited extent.

In an example embodiment, the decoding system further comprises a first delay line and a mixer. The first delay line receives the input signal and is operable to output a delayed version of the input signal. Alternatively, the first delay line may be operable to delay a processed version of the input signal, e.g., after the n channels have been derived from the input signal, or after de-packetization. The first delay line need not be active in the parametric mode (i.e., in those time frames in which the decoding system output is produced by spatial synthesis), possibly with the exception of an initial time frame in a sequence of time frames in which the decoding system is in discrete mode, to facilitate a mode transition. The mixer is connected both to the first delay line output and to the spatial synthesis stage output and acts as a selector between these two sources. In the parametric mode, the mixer outputs the spatial synthesis stage output. In the discrete mode, the mixer outputs the first delay line output. When there is a transition between discrete and parametric (or reduced parametric, if the decoding system is adapted to reformat received reduced parametrically coded time frames into n-channel format, as described above) coding regimes in the input signal, the mixer performs a mixing transition between the two outputs. The mixing transition may include a cross-fade-type operation or other mixing transition known to be not very perceptible. The mixing transition may occupy a time frame or a fraction of a time frame from which the mode transition takes place. The presence of the first delay line allows the n-channel representation of the audio signal provided by the spatial synthesis stage to remain in synchronicity with the signal derived on the basis of the n discretely encoded channels from the input signal. This furthers the smoothness of a mode transition. Further, the mixer will be able to transition between the modes with short latency, since there is no need for preliminary alignment of the two signals. In particular, the first delay line may be configured to delay the input signal by a period corresponding to a total pass-through time of the downmix stage and the spatial synthesis stage. The total pass-through time may be the sum of the respective pass-through times. However, the total pass-through time may be less than the sum if delay reduction measures are taken. It is noted that the pass-through time of the downmix stage may be a non-zero number or zero, particularly if the downmix stage operates in the time domain.

In a further development of the preceding embodiment, the decoding system further includes a second delay line downstream of the mixer. The second delay line is configured to function similarly in parametric mode and discrete mode, namely by adding a delay being the difference between a time frame duration and the delay incurred by the first delay line. Hence, the total pass-through time of the decoding system is exactly one time frame. Alternatively, the delay incurred by the second delay line is chosen such that the total delay incurred by the first and second delay lines corresponds to a multiple of the length of one time frame. Both these alternatives simplify switching. In particular, this simplifies the cooperation between the decoding system and connected entities in connection with switching.

In an example embodiment, the spatial synthesis stage is adapted to apply mixing parameter values obtained by time interpolation. In the parametric and reduced parametric coding regimes, the time frames may carry mixing parameter(s) which are explicitly defined for a reference point (or anchor point) in a given time frame, such as the midpoint or the end of the time frame. Based on the explicitly defined values, the spatial synthesis stage derives intermediate mixing parameter values for intermediate points in time by interpolation between respective reference points in consecutive (contiguous) time frames. In other words, interpolation may only be carried out between two consecutive (contiguous) time frames in case each of these two time frames carries a mixing parameter value, e.g., in case each of the time frames is either parametrically coded or reduced parametrically coded. In this setting, and particularly if the reference point is non-initial, the spatial synthesis stage is adapted to respond to the current time frame being the first time frame in an episode of time frames in which episode each time frame is either parametrically coded or reduced parametrically coded (i.e. the time frame preceding the current time frame does not carry mixing parameter values) by extrapolating the mixing parameter values backward from the reference point in the current time frame up to the beginning of the current time frame. The spatial synthesis stage may be configured to extrapolate the mixing parameters by constant values. This is to say, the mixing parameters will be taken to have their reference-point value at the beginning of the frame, will maintain this value (as an intermediate value) without variation up to the reference point, and will then initiate interpolation towards the reference point in the subsequent time frame. Preferably, the extrapolation may be accompanied by a transition into parametric mode in the decoding system. The spatial synthesis unit may be activated in the current time frame. During the current frame and/or the frame thereafter, the decoding system may transition into reconstructing the audio signal using the n-channel representation of the audio signal output from the spatial synthesis unit. The spatial synthesis stage may be adapted to perform forward extrapolation (of mixing parameter values) from a reference point in the time frame directly preceding the current time frame, when the current time frame is the first time frame in an episode of discretely coded time frames. The forward extrapolation may be achieved by keeping the mixing parameter values constant from the last reference point up to the end of the current time frame. Alternatively, the extrapolation may proceed for one further time frame after the current time frame, so as to accommodate a mode transition into the discrete mode. As a consequence, the spatial synthesis stage may use mixing parameter values extrapolated from one time frame (time frame directly preceding the current time frame) in combination with a core signal from the current time frame (or a subsequent time frame). During the frame after the current frame and/or the time frame thereafter, the decoding system may preferably transition into deriving the audio signal on the basis of the n discretely encoded channels contained in the input signal.

In an example embodiment, the spatial synthesis stage includes a mixing matrix operating on a frequency-domain representation of the downmix signal. The mixing matrix may be operable to perform an m-to-n upmix. To this end, the spatial synthesis stage further comprises, upstream of the mixing matrix, a time-to-frequency transform stage and, downstream of the mixing matrix, a frequency-to-time transform stage. Additionally or alternatively, the mixing matrix is configured to generate its n output channels by a linear combination including the m downmix channels. The linear combination may preferably include decorrelated versions of at least some of the downmix channels. The mixing matrix accepts the mixing parameters and reacts by adjusting at least one gain, relating to at least one of the downmix channels, in the linear combination in accordance with the values of the mixing parameters. The at least one gain may be applied to one or more of the channels in the m-channel frequency-domain representation of the downmix signal. A point change in a mixing parameter value may result in an immediate or gradual gain change; for instance, a gradual change may be achieved by interpolation between consecutive frames, as outlined above. It is noted that the controllability of the gains may be practised regardless of whether the upmix operation is carried out on a time-domain or frequency-domain representation of the downmix signal.

In an example embodiment, the downmix stage is adapted to operate on a time-domain representation of the input signal. More precisely, to produce the m-channel downmix signal, the downmix stage is supplied with a time-domain representation of the core signal or the n discretely encoded signals. Downmixing in the time domain is a computationally lean technique, which in typical use cases implies that operation of the downmix stage will increase the total computational load in the decoding system to a very little extent (compared to a decoder without a downmix stage). As already described, the quantitative properties of the downmixing are controllable by the downmix specification. In particular, the downmix specification may include the gains to be applied.

In an example embodiment, the spatial synthesis stage and the mixer, if such is provided in the decoding system, are controlled by a controller which may be implemented, e.g., as a finite state machine (FSM). The downmix stage may operate independently of the controller or it may be deactivated by the controller when downmix is not needed, e.g., when the input signal is reduced parametrically coded or when the input signal is discretely coded in a current and one (or more) previous time frame. The controller (e.g., finite state machine) may be a processor, the state of which is uniquely determined by the coding types/regimes (parametric, discrete, and if it is available, reduced parametric) of the current time frame and a previous time frame and, possibly, the time frame before the previous time frame as well. As will be seen below, the controller need not include a stack, implicit state variables or an internal memory storing anything but the program instructions in order to be able to practice the invention. This affords simplicity, transparency (e.g., in validation and testing) and/or robustness.

In an example embodiment, the audio signal may be represented, in each time frame, in accordance with the three coding regimes: discrete coding (D), parametric coding (P) and reduced parametric coding (rP). In the current example embodiment (in which the decoding system is not adapted to reformat reduced parametrically coded time frames into n-channel format, which it may be in other example embodiments as described above), the following sequence of consecutive (contiguous) time frames may be avoided:

rP D or D rP, i.e., discretely coded time frames are not (directly) followed or (directly) preceded by reduced parametrically coded time frames. In other words, a discretely coded time frame is followed by either a discretely coded time frame or a parametrically coded time frame, and a discretely coded time frame is preceded by either a discretely coded time frame or a parametrically coded time frame. Alternatively or additionally, the following sequences of consecutive (contiguous) time frames:

P rP P and P rP . . . rP P is preferred over:

P P P and P P . . . P P, respectively, for reasons of coding efficiency. In other words, each time frame following directly after a parametrically coded time frame may preferably be either reduced parametrically coded or discretely coded. An exception to this may be an implementation where very short episodes are accepted; in such circumstances, there may not always be enough time to enter the reduced parametric coding regime, whereby two consecutive parametrically coded time frames may occur.

In an example embodiment, in which the rules described above, relating to the order of time frames coded according to different regimes, are all applied, sequences of time frames in the input signal typically look like D D P D D D D Pr Pr Pr Pr Pr P P D D D P D P D D D Pr P P D D, where reduced parametric coding (rP) always separates discrete coding (D) and parametric (P) coding. It is to be noted that, as described above, encoding systems of at least some of the example embodiments described above, may be adapted to receive other combinations of (codling regimes of) consecutive frames.

In an example embodiment, decoding proceeds by deriving the n discretely encoded channels from the input signal in all cases where the input signal is discretely coded in a current time frame and in two previous time frames immediately before the current one. Additionally, decoding proceeds by generating an m-channel downmix signal based on the input signal in accordance with a downmix specification where the audio signal is parametrically coded in a current time frame or the current time frame being the first time frame in an episode of discretely coded time frames, and by generating an n-channel representation of the audio signal based on the downmix signal in all cases where the audio signal is parametrically coded in the current frame and in the two previous ones. The behaviour in a time frame where the input signal is parametrically coded (or reduced parametrically coded) in a current and only one previous time frame may differ between different example embodiments. Optionally, the m-channel downmix signal is generated also when the audio signal is parametrically coded in the time frame (immediately) before the previous time frame.

In a further development of this example embodiment, receiving the input signal (e.g., by decoding the bitstream) representing the audio signal, in a given time frame, either by parametric coding or reduced parametric coding, comprises receiving a value of the at least one mixing parameter for a non-initial point in the given time frame. If the current time frame is the first time frame in an episode of time frames in which episode each time frame is either parametrically coded or reduced parametrically coded, the received value of the at least one mixing parameter is backward extrapolated up to the beginning of the current time frame. Additionally, or alternatively, the receipt of two consecutive discretely coded time frames (the current and the previous) after a parametrically coded time frame causes the decoding system to carry out parametric decoding (i.e., generating an n-channel representation of the audio signal based on the downmix signal), however based on a mixing parameter value associated with the time frame preceding the previous time frame. Since there is no immediately subsequent time frame that could form a basis for forward interpolation, the decoding system extrapolates the last explicit mixing parameter value forward throughout the current frame. Meanwhile, the decoding system transitions into discrete decoding/mode, e.g., by performing cross mixing over an initial portion of the frame (e.g., ⅓, ¼ or ⅙ of its duration, the length of which has been discussed above). The method may further comprise the following step: in response to the input signal being parametrically coded in the current time frame and the previous time frame and discretely coded in the time frame preceding the previous time frame, transitioning during the current time frame into generating an n-channel representation of the audio signal based on the downmix signal and at least one mixing parameter.

In an example embodiment of the present invention, an encoding system is adapted to encode an n-channel audio signal segmented into time frames. The encoding system is adapted to output a bitstream (P) representing the audio signal, in a given time frame, according to a coding regime selected from the group comprising: parametric coding and discrete coding using n discretely encoded channels. The encoding system comprises a selector adapted to select, for a given time frame, which encoding regime is to be used to represent the audio signal. The encoding system further comprises a parametric analysis stage operable to output, based on an n-channel representation of the audio signal and in accordance with a downmix specification, a core signal and at least one mixing parameter, which are to form part of the output bitstream in parametric coding. In a further development of the present example embodiment, the group of coding regimes further comprises reduced parametric coding. In the present embodiment, the parametric coding uses a format with n signal channels, and so does the discrete coding. The reduced parametric coding, on the other hand, uses a format with m signal channels, where $n>m\geq 1$.

Within a second additional aspect of the present invention, there is provided a decoding system for reconstructing an n-channel audio signal. The decoding system is adapted to receive a bitstream encoding an input signal. The input signal is segmented into time frames and represents the audio signal, in a given time frame, according to a coding regime selected from the group comprising: discrete coding using n discretely encoded channels to represent the audio signal; and reduced parametric coding using an m-channel core signal and at least one mixing parameter to represent the audio signal, wherein $n>m\geq 1$. It is to be noted that the reduced parametric coding regime may for example use metadata such as at least one mixing parameter, in addition to the core signal, to represent the audio signal.

The decoding system of the present example embodiment is operable to derive the audio signal either on the basis of the n discretely encoded channels or by spatial synthesis. The decoding system comprises an audio decoder adapted to transform a frequency-domain representation of the input signal, which it extracts from the bitstream, into a time-domain representation of the input signal. The decoding system further comprises a downmix stage operable to output an m-channel downmix signal based on the time-domain representation of the input signal in accordance with a downmix specification, and a spatial synthesis stage operable to output an n-channel representation of the audio signal based on the downmix signal and at least one mixing parameter (e.g., received in the same bitstream and extracted by the audio decoder, or received separately, e.g., in some other bitstream).

In reduced parametrically coded time frames of the present example embodiment, the frequency-domain representation of the input signal is an m-channel signal (i.e., the core signal), unlike the discretely coded time frames in which the frequency-domain representation of the input signal is an n-channel signal. The audio decoder may be adapted to reformat the frequency-domain representation of the input signal (that is, to modify its format), before transforming it into the time domain, in at least portions of reduced parametrically coded time frames adjacent to discretely coded time frames in order for the frequency-domain representation (and thereby also the time-domain representation) of the input signal in these portions to have the same number of channels as in the discretely coded time frames. The time-domain representations of the input signal having a constant number of channels during transitions between discrete coding and reduced parametric coding (but not necessarily constant during episodes of reduced parametrically coded time frames) may contribute to providing a smooth listening experience also during such transitions. This is achieved by facilitating the transition in decoding/processing sections arranged further downstream in the decoding system. For example, having a constant number of channels may facilitate providing a smooth transition in the time-domain representation of the input signal.

For this purpose, the audio decoder may be adapted to reformat the frequency-domain representation of the input signal, during at least an initial portion of each reduced parametrically coded time frame directly succeeding a discretely coded time frame and for at least a final portion of each reduced parametrically coded time frame directly preceding a discretely coded time frame. The audio decoder is adapted to reformat the frequency-domain representation of the input signal (which is represented by an m-channel core signal in the reduced parametrically coded time frames) at these portions into n-channel format by appending n−m neutral channels to the m-channel core signal. The neutral channels may be channels containing neutral signal values, i.e., values corresponding to no audio content or no excitation, such as zero. In other words, the neutral values may be chosen such that when the content of the neutral channels is added to channels containing an audio signal, the addition by which the audio signal is produced is unaffected by the neutral values (the neutral value plus the non-neutral contribution is equal to the non-neutral contribution) but still well-defined as an operation. In the above described way, the m-channel core signal of the frequency-domain representation of the audio signal in (at least portions of some) reduced parametrically coded time frames may be reformatted by the audio decoder into a format homogenous to the format of the input signal in discretely coded time frames, particularly a format comprising the same number of channels.

According to an example embodiment, the audio decoder may be adapted to perform a frequency-to-time transform using overlapping transform windows, wherein each of the time frames is equivalent to (e.g., has the same length as) the half-length of at least one of the transform windows. In other words, each time frame may correspond to a time period being at least half as long as the time period equivalent to one transform window. As the transform windows are overlapping, there may be overlaps between transform windows from different time frames, and values of the time-domain representation of the input signal in a given time frame, may therefore be based on contributions from a time frames other than the given time frame, e.g., at least a time frame directly preceding or directly succeeding the given time frame.

In an example embodiment, the audio decoder may be adapted to determine, in each reduced parametrically coded time frame directly succeeding a discretely coded time frame, at least one channel of the time-domain representation of the input signal by summing at least a first contribution, from at least one of the neutral channels of the reduced parametrically coded time frame, and a second contribution, from the directly preceding discretely coded time frame. As described in relation to a preceding embodiment, an m-channel core signal represents the input signal (in the frequency domain) in reduced parametrically coded time frames, and the audio decoder may be adapted to append m−n neutral channels to the m-channel core signal in (at least on an initial portion of) reduced parametrically coded time frames directly succeeding discretely coded time frames. An n-channel time-domain representation of the input signal may be obtained in such a reduced parametrically coded time frame by summing, for each of the n channels, contributions from corresponding channels of the preceding discretely coded time frame and the reduced parametrically coded time frame. For each of the m channels corresponding to the m-channel core signal, this may comprise summing a first contribution from a channel of the core signal (from the reduced parametrically coded time frame) and a second contribution from the corresponding channel in the discretely coded time frame. For each of the n−m channels corresponding to the n−m neutral channels, this may correspond to summing a first contribution from one of the neutral channels (i.e. a neutral value such as zero) and a second contribution from the corresponding channel in the preceding discretely coded time frame. In this way, contributions from all the n channels of the discretely coded time frame may be used when forming the time-domain representation for the input signal in the reduced parametrically coded time frame directly succeeding the discretely coded time frame. This may allow for a smoother, and/or less noticeable transition in the time domain representation of the input signal. For example, the contribution from the discretely coded time frame may be allowed to fade out in the n−m channels corresponding to the n−m neutral channels in the reduced parametric coding. This may also facilitate processing/decoding of the input signal in stages/units arranged further downstream in the decoding system in order to achieve an improved (or a smoother) listening experience during transitions between discrete and reduced parametric coding of the input signal.

In an example embodiment, the audio decoder may be adapted to determine, in each discretely coded time frame directly succeeding a parametrically coded time frame, at least one channel of the time-domain representation of the input signal by summing at least a first contribution, from the discretely coded time frame, and a second contribution, from at least one of the neutral channels of the directly preceding reduced parametrically coded time frame. As described in relation to a preceding embodiment, an m-channel core signal represents the input signal (in the frequency domain) in reduced parametrically coded time frames, and the audio decoder may be adapted to append m−n neutral channels to the m-channel core signal in (at least a final portion of) reduced parametrically coded time frames directly preceding discretely coded time frames. An n-channel time-domain representation of the input signal may be obtained in a discretely coded time frame directly succeeding such a reduced parametrically coded time frame by summing, for each of the n channels, contributions from corresponding channels of the discretely coded time frame and the preceding reduced parametrically coded time frame. For each of the m channels corresponding to the m-channel core signal, this may comprise summing a first contribution from the corresponding channel in the discretely coded time frame and a second contribution from the corresponding channel of the core signal (from the reduced parametrically coded time frame). For each of the n−m channels corresponding to the n−m neutral channels, this may correspond to summing a first contribution from the corresponding channel in the discretely coded time frame and a second contribution from the corresponding neutral channel (i.e. a neutral value such as zero) from the preceding reduced parametrically coded time frame. In this way, contributions from the m channels of the core signal in the reduced parametrically coded time frame may be used when forming the time-domain representation for the input signal in the directly succeeding discretely coded time frame, e.g. to let the values of the corresponding channels of the discretely coded time frame fade in during an initial portion of the discretely coded time frame. Moreover, in the remaining n−m channels, the neutral values (e.g. zero) in the channels appended to the m-channel core signal may be used to let the values of the corresponding channels of the discretely coded time frame fade in. In particular, any values remaining in buffers/memory of the audio decoder from earlier discretely coded time frames and relating to the n−m channels (typically) not used during episodes of reduced parametric coding, may be replaced by the neutral values of the appended neutral channels, i.e. may not be allowed to affect the audio output of the encoding system at this later discretely coded time frame. The earlier discretely coded time frames referred to above may potentially be located many time frames before the current discretely coded time frame, i.e. they may be separated from the current discretely coded time frame by many reduced parametrically coded time frames, and may potentially correspond to audio content several seconds or even minutes back in the audio signal represented by the input signal. It may therefore be desirable to avoid using data and/or audio content relating to these earlier discretely coded time frames when decoding the current discretely coded time frame.

The present example embodiment may allow for a smoother, and/or less noticeable transition in the time domain representation of the input signal (caused by a transition from reduce parametric coding to discrete coding). It may also facilitate further processing/decoding of the input signal in stages/units further downstream in the decoding system in order to achieve an improved (or smoother) listening experience during transitions between reduced parametric coding and discrete coding of the input signal.

In an example embodiment, the downmix stage may be adapted to be active in at least the first time frame in each episode of discretely coded time frames and in at least the first time frame after each episode of discretely coded time frames. The downmix stage may preferably be active in initial portion of these time frames, i.e. during transitions to and from discrete coding in the time domain representation for the input signal. It may then provide a downmix signal during these transitions, which may be used to provide an output of the encoding system with an improved (or smoother) listening experience during transitions to and from discrete coding in the input signal.

In an example embodiment, the group of coding regimes may further comprise parametric coding. The decoding system may be adapted to receive a bitstream encoding an input signal comprising, in each time frame in which the input signal represents the audio signal by parametric coding, an m-channel core signal being such that, in each time frame in which the input signal represents the audio signal as n discretely encoded channels, an m-channel core signal representing the same audio signal is obtainable from the input signal using the downmix specification.

In the present example embodiment, the time frames of the input signal received via the bitstream may be coded using any of the three coding regimes: discrete coding, parametric coding and reduced parametric coding. In particular, a time frame coded in any one of these coding regimes may follow after a time frame coded in any one of these coding regimes. The decoding system may be adapted to handle any transition between time frames coded using any of these three coding regimes.

Within the second additional aspect of the present invention, there is provided a method of reconstructing an n-channel audio signal analogous to (the method performed by) the decoding system described in any of the preceding example embodiments. The method may comprise receiving a bitstream; extracting a frequency-domain representation of the input signal from the bitstream; and in response to the input signal being reduced parametrically coded in a current time frame and discretely coded in a directly preceding time frame, or the input signal being reduced parametrically coded in a current time frame and discretely coded in a directly succeeding time frame, reformatting at least a portion of the current time frame of the frequency-domain representation of the input signal into n-channel format; and transforming the frequency-domain representation of the input signal into a time-domain representation of the input signal. The method may further comprise: in response to the input signal being discretely coded in a current and (one or) two directly preceding time frames, deriving the audio signal on the basis of the n discretely encoded channels; and in response to the input signal being reduced parametrically coded in a current and (one or) two directly preceding time frames, generating an n-channel representation of the audio signal based the core signal and the at least one mixing parameter.

Within the second additional aspect of the present invention, there is provided an encoding system for encoding an n-channel audio signal segmented into time frames, wherein the encoding system is adapted to output a bitstream representing the audio signal, in a given time frame, according to a coding regime selected from the group comprising: discrete coding using n discretely encoded channels; and reduced parametric coding. The encoding system comprises a selector adapted to select, for a given time frame, which encoding regime is to be used to represent the audio signal; and a parametric analysis stage operable to output, based on an n-channel representation of the audio signal and in accordance with a downmix specification, an m-channel core signal and at least one mixing parameter, which are to be encoded by the output bitstream in the reduced parametric coding regime. Optionally, the encoding system may be operable to output the bitstream representing the audio signal, in a given time frame, also according to a parametric coding regime, and the selector may be adapted to select, for a given time frame, between discrete coding, parametric coding and reduced parametric coding.

Within the second additional aspect of the present invention, there is provided a method of encoding an n-channel audio signal as a bitstream, the method being analogous to (the methods performed by) the encoding systems of any of the preceding embodiments. The method may comprise: receiving an n-channel representation of the audio signal; selecting a coding regime to be used to represent the audio signal, in a given time frame; in response to a selection to encode the audio signal by reduced parametric coding, forming, based on the rechannel representation of the audio signal and in accordance with a downmix specification, a bitstream encoding an m-channel core signal and at least one mixing parameter; and in response to a selection to encode the audio signal by discrete coding, outputting a bitstream encoding the audio signal by n discretely encoded channels.

Within the second additional aspect of the present invention, there is provided an audio transmission system comprising an encoding system and a decoding system, according to any of the preceding embodiments of such systems. The systems are communicatively connected and the respective downmix specifications of the encoding system and decoding system are equivalent.

It is to be noted that the coding regimes (discrete coding, parametric coding, and reduced parametric coding) described in relation to embodiments of the second additional aspect of the present invention are the same coding regimes as described in relation to the first additional aspect of the present invention, and that additional embodiments of the second additional aspect of the present invention may be obtained by combining the already described embodiments (or combinations thereof) of the second additional aspect of the present invention with features from the embodiments described in relation to the first additional aspect of the present embodiment. In doing so, it is to be noted that for at least some features from embodiments according to the first additional aspect of the present invention, parametrically coded time frames and reduced parametrically coded time frames may be used interchangeably, i.e. there may be no need to distinguish between these two coding regimes.

It is further noted that a person skilled in the art will appreciate the keep mode, as explained herein, to be one core aspect of the invention which may or may not be combined or alternate with other operating modes. Furthermore, the n channels of the audio signal may not necessarily correspond to a directly "audible" signal but may also include interim signal components from which an audible signal is later reconstructed/derived.

Also, the spatial synthesis may include an upmix operation which extends the m input signal components to the (at least approximated) n audio signal components, wherein the n audio signal components may be related to an extended spatialization relative to the m components of the input signal.

Thus, the invention also leads to decoding system for reconstructing an audio signal having n components, wherein the decoding system is adapted to receive an input signal segmented into time frames and representing the audio signal, in a given time frame, according to a parametric coding regime comprising parametric coding in which the input signal comprises m components and at least one mixing parameter, where n>m≥1, wherein the decoding system is configured to reconstruct the n components of the audio signal by an upmix operation based on said m components and said at least one mixing parameter from a current frame, the decoding system comprising a controller for controlling a mode of the decoding system on the basis of at least a current mode of the decoding system and a current received frame of the input signal, wherein the controller is configured to respond to receipt of a defective frame by entering a keep mode in which the decoding system reconstructs the n components of the audio signal by an upmix operation based on the m components of the input signal related to the defective frame and at least one mixing parameter related to a previous frame.

The controller may further be configured to respond to receipt of a further defective frame, when in the keep mode, by remaining in the keep mode.

The controller also can include a keep mode counter causing the controller to respond to receipt of a further defective frame, when having remained in the keep mode for a predetermined maximum duration, by entering a further mode and otherwise by remaining in the keep mode.

In the latter embodiment, the further mode may be a fallback mode including outputting the m components as a decoder output signal.

Advantageously, the controller can further be configured to resume operating in the parametric coding regime, when in the keep mode, upon receiving a frame in which said at least one mixing parameter is decodable.

The invention leads to a further method for reconstructing an audio signal having n components, wherein the method comprises:

- receiving an input signal segmented into time frames and representing the audio signal, in a given time frame, according to a parametric coding regime comprising parametric coding in which the input signal comprises m components and at least one mixing parameter, where n>m≥1; and
- reconstructing the n components of the audio signal by an upmix operation based on said m components and said at least one mixing parameter from a current frame,
- wherein said at least one mixing parameter from the current frame is substituted or supplemented by at least one mixing parameter from a previous frame if the current frame is a defective frame.

A defective frame can e.g. have at least one mixing parameter which is not decodable.

In any of the previously mentioned decoding systems or methods, n may be an integer selected from the range [10; 128] and m may be a further integer selected from the range [2; 13].

Specifically, n may be either 10 or 12 or 16 and m may be either 6 or 8.

III. Example Embodiments

Switching Behaviour and Mode Transitions

FIG. 1 illustrates in block-diagram form a decoding system 100 in accordance with an example embodiment of the invention. An audio decoder 110 receives a bitstream P and generates from it, in one or more processing steps, an input signal, denoted by an encircled letter A, representing an n-channel audio signal. As one example, one may use the Dolby Digital Plus format (or Enhanced AC-3) together with an audio decoder 110 adapted thereto. The inner workings of the audio decoder 110 will be discussed in greater detail below. The input signal A is segmented into time frames corresponding to time segments of the audio signal. Preferably, consecutive time frames are contiguous and non-overlapping. The input signal A represents the audio signal, in a given time frame, either (b) by parametric coding or (a) as n discretely encoded channels W. The parametric coding data comprise an m-channel core signal, corresponding to a downmix signal X obtainable by downmixing the audio signal. The parametric coding data received in the input signal A may also include one or more mixing parameters, collectively denoted by $\alpha$, which are associated with the downmix signal X. Alternatively, the at least one mixing parameter $\alpha$ associated with the downmix signal X may be received through a signal separate from the input signal in the same bitstream P or a different bitstream. Information about the current coding regime of the input signal (i.e., parametric coding or discrete coding) may be received in the bitstream P or as a separate signal. In the decoding system shown in FIG. 1, the audio signal has six channels and the core signal has two channels, i.e., m=2 and n=6. In some passages of this disclosure, in order to indicate explicitly that some connection lines are adapted to transmit multi-channel signals, these lines have been provided with a cross line adjacent to the respective number of channels. The input signal A may in the discrete coding regime be a representation of the audio signal as 5.1 surround with channels L (left), R (right) and C (centre), Lfe (low frequency effects), Ls (left surround), Rs (right surround). In parametric coding regime, however, the L and R channels are used to transmit core signal channels L0 (core left) and R0 (core right) in 2.0 stereo.

The decoding system 100 is operable in a discrete mode, in which the decoding system 100 derives the audio signal from the n discretely encoded channels W. The decoding system 100 is also operable in a parametric mode in which the decoding system 100 reconstructs the audio signal from the core signal by performing an upmix operation including spatial synthesis.

A downmix stage 140 receives the input signal and performs a downmix of the input signal in accordance with a downmix specification and outputs an m-channel downmix signal X. In the present embodiment, the downmix stage 140 treats the input signal as an n-channel signal, i.e., if the input signal contains only an m-channel core signal, the input signal is considered having n−m additional channels which are empty/zero. In practice, this may translate to padding the non-occupied channels by neutral values, such as a sequence of zeros. The downmix stage 140 forms an m-channel linear combination of the n input channels and outputs these as the downmix signal X. The downmix specification specifies the gains of this linear combination and is independent of the coding of the input signal, i.e., when the downmix stage 140 is active, it operates independently of the coding of the input signal.

In the present embodiment, when the audio signal is parametrically coded, the downmix stage 140 receives an m-channel core signal with n−m empty channels. The gains of the linear combination specified by the downmix specification are chosen such that, when the audio signal is parametrically coded, the downmix signal X is then the same as the core signal, i.e. the linear combination passes through the core signal. The downmix stage may be modelled as follows:

$$\begin{pmatrix} L_0 \\ R_0 \end{pmatrix} = \begin{pmatrix} 1 & 0 & * & * & * & * \\ 0 & 1 & * & * & * & * \end{pmatrix} (L \;\; R \;\; C \;\; Ls \;\; Rs \;\; Lfe)^T,$$

where each * symbol denotes an arbitrary entry.

In this example embodiment, the spatial synthesis stage 150 receives the downmix signal X. In the parametric mode, the spatial synthesis stage 150 performs an upmix operation on the downmix signal X using the at least one mixing parameter α, and outputs an n-channel representation Y of the audio signal.

The spatial synthesis stage 150 comprises a first transform stage 151 which receives a time-domain representation of the m-channel downmix signal X and outputs, based thereon, a frequency-domain representation $X_f$ of the downmix signal X. An upmix stage 155 receives the frequency-domain representation $X_f$ of the downmix signal X and the at least one mixing parameter α. The upmix stage 155 performs the upmix operation and outputs a frequency-domain representation $Y_f$ of the n-channel representation of the audio signal. A second transform stage 152 receives the frequency-domain representation $Y_f$ of the n-channel representation Y of the audio signal and outputs, based thereon, a time-domain representation Y of the n-channel representation of the audio signal as output of the spatial synthesis stage 150.

The decoding system 100 comprises a first delay line 120 receiving the input signal and outputting a delayed version of the input signal. The amount of delay incurred by the first delay line 120 corresponds to a total pass-through time associated with the downmix stage 140 and the spatial synthesis stage 150.

The decoding system 100 further comprises a mixer 130, which is communicatively connected to the spatial synthesis 150 stage and the first delay line 120. In the parametric mode, the mixer receives the n-channel representation Y of the audio signal from the spatial synthesis stage 150 and a delayed version of the input signal from the first delay line 120. The mixer 130 then outputs the n-channel representation Y of the audio signal. In the discrete mode, the mixer 130 receives a delayed version of the n discretely encoded channels W from the delay line 120 and outputs this. When the encoding of the input signal changes between parametric coding and n discretely encoded channels, the mixer 130 outputs a transition between the spatial synthesis stage output and the delay line output.

In some embodiments, the decoding system 100 may further comprise a second delay line 160 receiving the output from the mixer 130 and outputting a delayed version thereof. The sum of the delays incurred by the first delay line 120 and the second delay line 160 may correspond to the length of one time frame or a multiple of time frames.

Optionally, the decoding system 100 may further comprise a controller 170 (which may be implemented as a finite state machine) for controlling the spatial synthesis stage 150 and the mixer 130 on the basis of the coding regime of the audio signal received by the decoding system 100, but not on the basis of memory content, buffers or other stored information. The controller 170 (or finite state machine) controls the spatial synthesis stage 150 and the mixer 130 on the basis of the coding regime of the audio signal in the current time frame as well as the coding in the previous time frame (i.e. the one immediately before the present), but not the signal values therein. The controller 170 may control the spatial synthesis stage 150 and the mixer 130 on the basis, further, of the time frame (immediately) before the previous time frame. The controller 170 may optionally control also the downmix stage 140; with this optional functionality, the downmix stage 140 may be deactivated at times when it is not required, e.g., in reduced parametric coding, when a core signal in a format that suits the spatial synthesis stage 150 can be derived in an immediate fashion—or even copied—from the input signal. The operation of the controller 170 according to different example embodiments is described further below with reference to Tables 1 and 2 as well as FIGS. 6 and 8.

Figure 4:
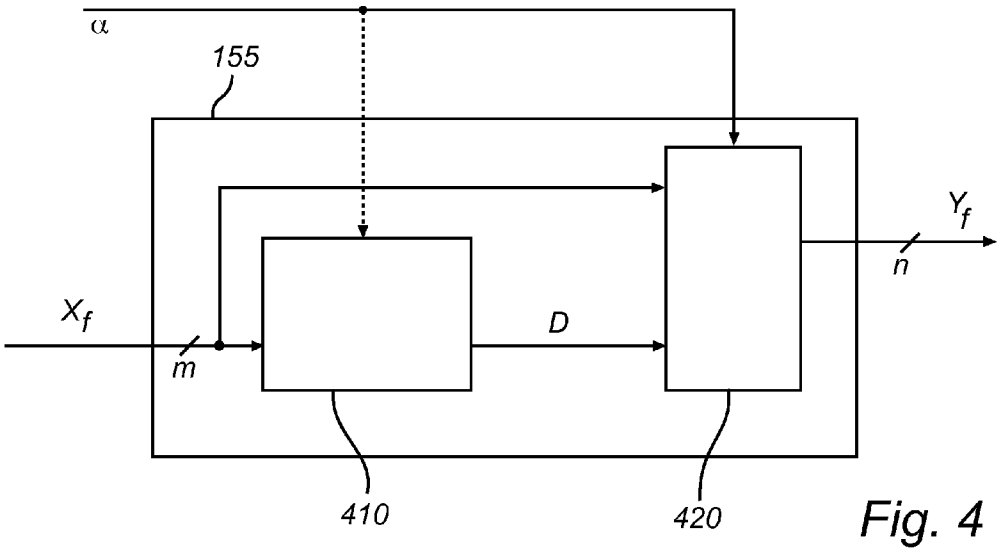
FIG. 4 shows details of an upmix stage according to an example embodiment for deployment in a decoding system.

Referring to FIG. 4, the upmix stage 155 may comprise a downmix modifying processor 410, which in an active state of the upmix stage 155 receives the frequency-domain representation $X_f$ of the downmix signal X and outputs a modified downmix signal D. The modified downmix signal D may be obtained by non-linear processing of the frequency-domain representation $X_f$ of the downmix signal X. For example, the modified downmix signal D may be obtained by first forming new channels as linear combinations of the channels of the frequency-domain representation $X_f$ of the downmix signal X, letting the new channels pass through decorrelators, and finally subjecting the decorrelated channels to artefact attenuation before outputting the result as the modified downmix signal D. The upmix stage 155 may further comprise a mixing matrix 420 receiving the frequency-domain representation $X_f$ of the downmix signal X and the modified downmix signal D, forming an n-channel linear combination of the received downmix signal channels and modified downmix signal channels only and outputting this as the frequency-domain representation $Y_f$ of the n-channel representation Y of the audio signal. The mixing matrix 420 may accept at least one mixing parameter α controlling at least one of the gains of the linear combination formed by the mixing matrix 420. Optionally, the downmix modifying processor 410 may accept the at least one mixing parameter α, which may control the operation of the downmix modifying processor 410.

Figure 2:
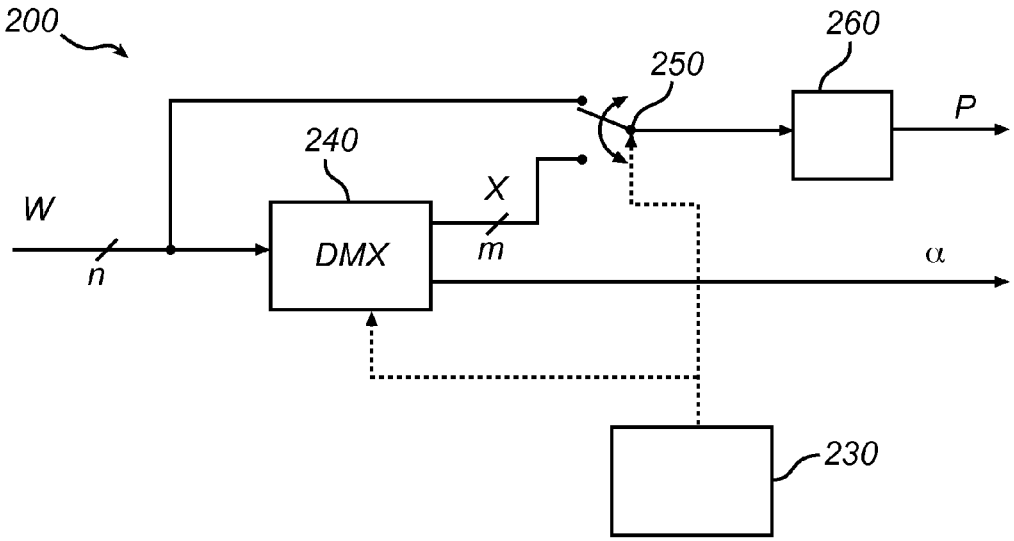
FIG. 2 shows, similarly to FIG. 1, an encoding system in accordance with an example embodiment of the invention.

FIG. 2 illustrates, in block-diagram form, an encoding system 200 in accordance with an example embodiment of the invention. The encoding system 200 receives an rechannel representation W of an n-channel audio signal and generates an output signal P encoding the audio signal.

The encoding system 200 comprises a selector 230 adapted to decide, for a given time frame, whether to encode the audio signal by parametric coding or by n discretely encoded channels. Considering that discrete coding typically achieves higher perceived listening quality at the cost of more bandwidth occupancy, the selector 230 may be configured to base its choice of a coding mode on the momentary amount of downstream bandwidth available for the transmission of the output signal P.

The encoding system 200 comprises a downmix stage 240 which receives the rechannel representation W of the audio signal and which is communicatively connected to the selector 230. When the selector 230 decides that the audio signal is to be coded by parametric coding, the downmix stage 240 performs a downmix operation in accordance with a downmix specification, calculates at least one mixing parameter α and outputs an m-channel downmix signal X and the at least one mixing parameter α.

The encoding system 200 comprises an audio encoder 260. The selector 230 controls, using a switch 250 (symbolizing any hardware- or software-implemented signal selection means), whether the audio encoder 260 receives the n-channel representation W of the rechannel audio signal or whether it receives the downmix signal X (an n-channel signal comprising the m-channel downmix signal X and n-m empty/neutral channels). Alternatively, the encoding system 200 further comprises a combination unit (not shown) receiving the downmix signal X and the at least one mixing parameter α, and outputting, based on these, a combined signal representing the audio signal by parametric coding. In that case, the selector 230 controls, using a switch, whether the audio encoder 260 receives the n-channel representation W of the n-channel audio signal or whether it receives the combined signal. The combination unit may be, e.g., a multiplexer.

The audio encoder 260 encodes the received channels individually and outputs the result as the output signal P. The output signal P may be, e.g., a bitstream.

In an alternative embodiment of the encoding system 200 shown in FIG. 2, the selector 230 is adapted to decide, for a given time frame, whether to encode the audio signal by reduced parametric coding (i.e. using the m-channel downmix signal and not the extra n−m neutral channels appended in parametric coding) or by n discretely encoded channels. The selector 230 is adapted to select, by the switch 250, whether the audio encoder 260 receives the n-channel representation W of the n-channel audio signal or whether it receives the m-channel downmix signal X (without any additional neutral channels).

Figure 9:
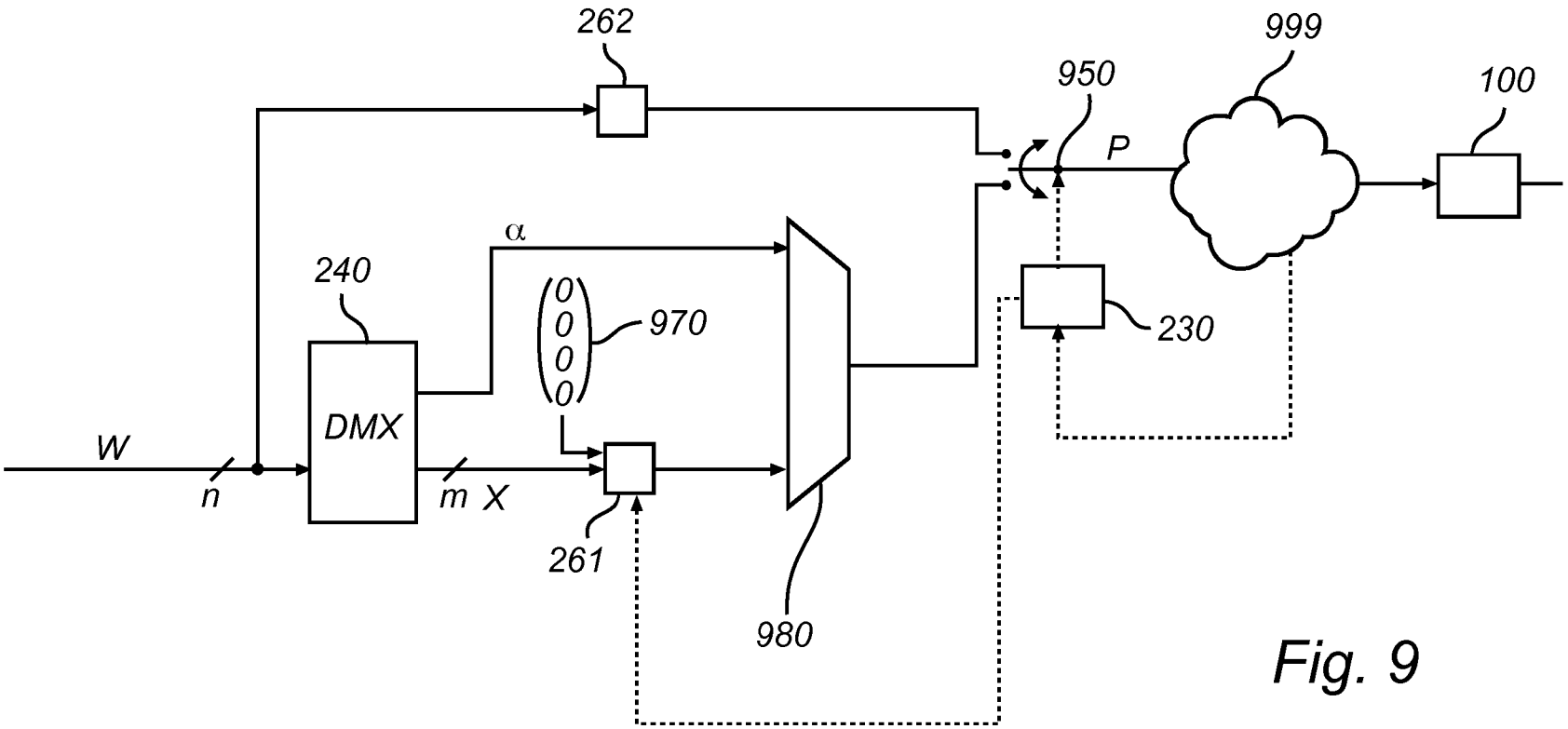
FIG. 9 shows an encoding system transmitting information to a decoder device, in accordance with an example embodiment of the invention.

FIG. 9 illustrates, in block-diagram form, an encoding system in accordance with an example embodiment of the invention. In the present embodiment, n=6 and m=2. The encoding system is shown together with a communication network 999, which connects it to a decoding system 100.

The encoding system receives an n-channel representation W of an n-channel audio signal and generates an output signal P encoding the audio signal. The encoding system comprises a downmix stage 240 which receives the n-channel representation W of the audio signal. The downmix stage 240 performs a downmix operation in accordance with a downmix specification and additionally calculates at least one mixing parameter α and outputs an m-channel downmix signal X and the at least one mixing parameter α.

The encoding system comprises a first audio encoder 261 receiving the downmix signal and n−m empty channels with neutral values 970, i.e. four channels which are present in the format but not used to represent the audio signal. Instead, these channels may be assigned neutral values. The first encoder 261 encodes the received channels individually and outputs the result as an n-channel intermediate signal. The encoding system further comprises a combination unit 980 receiving the intermediate signal and the at least one mixing parameter α, and outputting, based on these, a combined signal representing the audio signal by parametric coding. The combination unit may be, e.g., a multiplexer.

The encoding system comprises a second audio encoder 262 receiving the n-channel representation W of the n-channel audio signal and outputting n discretely encoded channels.

The encoding system further comprises a selector 230 communicatively connected to the communication network 999, through which the output signal P is transmitted before it reaches a decoding system 100. Based on current conditions (e.g., momentary load, available bandwidth etc.) of the network 999, the selector 230 controls, using a switch 950 (symbolizing any hardware- or software-implemented signal selection means), whether the encoding system outputs, in a given time frame, the combined signal or the n discretely encoded channels as the output signal P. The output signal P may be, e.g., a bitstream.

In the present embodiment, as compared to the embodiment described in relation to FIG. 2, the downmix stage 240 may be active independently of the decisions of the selector 230. In fact, the upper and lower portions of the encoding system in FIG. 9 provide the parametric representation of the audio signal, as well as the discrete representation, which may thus be formed in each given time frame independently of the decision on which one to pick for use as output signal P.

In a further development of the encoding system shown in FIG. 9, the first audio encoder 261 is operable to either include the n−m empty channels or to disregard the empty channels. If the first audio encoder 261 is in a mode in which it disregards the channels, it will output an m-channel signal. The combination unit 980 will function similarly to the previous description, that is, it will form a combined signal (e.g., a bitstream) which includes a core signal in m-channel format and the at least one mixing parameter α. The selector 230 may be configured to control the first audio encoder 261 as far as the inclusion or non-inclusion of the n−m empty channels is concerned. Hence, taking the action of the switch 950 into account, the encoding system in FIG. 9 according to this further development may output three different types of bitstreams P. The three types correspond to each of the discrete, parametric and reduced parametric coding regimes described above.

Figure 3:
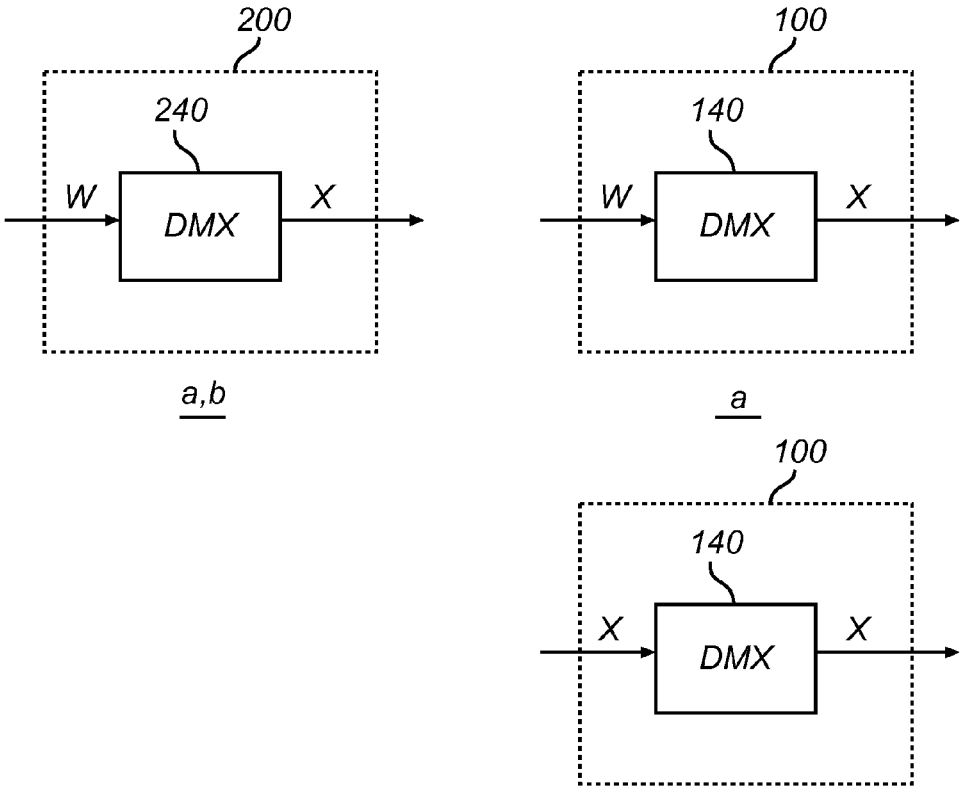
FIG. 3 illustrates the functioning of downmix stages located on the encoder and the decoder side.

Referring to FIG. 3, the downmix stage 240 located in the encoding system 200 receives an n-channel signal representation W of an audio signal and outputs (when it is activated by the selector 230) an m-channel downmix signal X in accordance with a downmix specification. (It should be noted that the downmix stage 240 may also output mixing parameters as previously described with reference to FIG. 2.) The downmix stage 140 located in the decoding system 100 also outputs an m-channel downmix signal X, and in accordance with an identical downmix specification. However, the input to this downmix stage 140 may represent an audio signal either as n discretely encoded channels W or by parametric coding. When the bitstream P represents the audio signal by parametric coding, the bitstream P contains a core signal which passes through the downmix stage 140 unchanged and becomes the downmix signal X. In parametric coding, the core signal is represented in n-channel format (with n−m channels that are present but not used), while the downmix signal is an m-channel signal. In reduced parametric coding, both the core signal and the downmix signal are in m-channel format, so that no format change is needed; instead, the downmix stage 140 may be deactivated and the signal may be supplied to the spatial synthesis stage 150 over a line arranged in parallel with the downmix stage 140.

Figure 5:
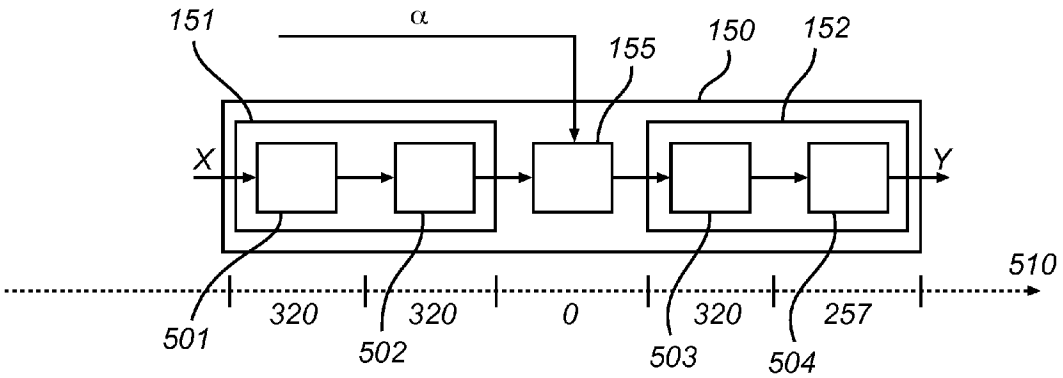
FIG. 5 shows details of a spatial synthesis stage according to an example embodiment for deployment in a decoding system.

Referring now to FIG. 5, the spatial synthesis stage 150 of FIG. 1 may comprise the following units, listed in the order from upstream to downstream: a first transform unit 501, a first transform modifier 502, an upmix stage 155, a second transform modifier 503 and a second transform unit 504.

The first transform unit 501 receives a time-domain representation of the m-channel downmix signal X and transforms it into a real-valued frequency-domain representation. The transform unit 501 may utilize for example a real-valued QMF analysis bank. The first transform modifier 502 converts this real-valued frequency-domain representation into a partially complex frequency-domain representation in order to improve the performance of the decoding system, e.g., by reducing aliasing effects that may appear if processing is performed on transformed signals which are critically sampled. The complex frequency-domain representation of the downmix signal X is supplied to the upmix stage 155. The upmix stage 155 receives at least one mixing parameter $\alpha$ and outputs a frequency-domain representation of the n-channel representation Y of the audio signal. The mixing parameter $\alpha$ may be included in the bitstream together with the core signal. The second transform modifier 503 modifies this signal into a real-valued frequency-domain representation of the n-channel representation Y of the audio signal, e.g., by updating real spectral data on the basis of imaginary spectral data so as to reduce aliasing, and supplies it to the second transform unit 504. The second transform unit 504 outputs a time-domain representation of the n-channel representation Y of the audio signal as output of the spatial synthesis stage 150.

In this example embodiment, each time frame consists of 1536 time-domain samples. Because all processing steps cannot be performed on one time-domain sample at a time, the units in the spatial synthesis stage may be associated with different (algorithmic) delays indicated on a time axis 510 in FIG. 5. The delay incurred may then be 320 samples for the first transform unit 501, 320 samples for the first transform modifier 502, 0 samples for the upmix stage 155, 320 samples for the second transform modifier 503 and 257 samples for the second transform unit 504. As previously described with reference to FIG. 1, a second delay line 160 may be introduced further downstream of the spatial synthesis stage 150 in a location where it delays both processing paths in the decoding system 100. The delay incurred by the second delay line 160 may be chosen to be 319 samples, whereby the combined delay of the spatial synthesis stage 150 and second delay 160 line is 1536 samples, i.e., the length of one time frame.

Table 1 lists those combinations of different modes of operation of different parts or aspects of an example embodiment (of a first type) of the decoding system 100 which may arise in a time frame. With reference to FIG. 1, at least one mixing parameter $\alpha$ is received by the spatial synthesis stage 155 when the input signal encodes the audio signal by parametric coding. The use of mixing parameters in the spatial synthesis stage 150 is referred to as aspect 1. The operation of the spatial synthesis stage 150 is referred to as aspect 2. The modes of the decoding system 100 as a whole are referred to as aspect 3. Assuming for the sake of this example that a time frame is split into 24 QMF slots of 64 samples each, the number of such slots in which mixing parameters are used is indicated as aspect 4.

TABLE 1

| Available modes of operation, FIG. 5 | |
|---|---|
| Aspect 1 | E (extrapolate), N (normal), K (keep) |
| Aspect 2 | R (reset), N (normal) |
| Aspect 3 | PM (parametric mode), PM→DM, DM (discrete mode), DM→PM |
| Aspect 4 | 0 (none), 24 (full) |

In the table and later in FIGS. 6 and 8, R (reset) refers to emptying an overlap-add buffer in the spatial synthesis stage 150; E (extrapolate) refers to backward extrapolation by a constant value; K (keep) refers to forward extrapolation by a constant value; N (normal) refers to inter-frame interpolation using the explicit values defined for the (non-initial) reference points in respective pairs of consecutive frames.

Depending on the coding of the audio signal in the input signal received by the encoding system 100, the aspects listed in Table 1 will be operating as listed. In the present embodiment, the modes of operation depend only on the coding regime in the current time frame and in the previous time frame as listed in Table 2, where N represents the current time frame and N−1 represents the previous time frame.

TABLE 2

| FSM programming/Received time frame combinations vs. combinations of modes of operation | | | | |
|---|---|---|---|---|
| Time frame | Coding regimes in time frames N and N − 1 | | | |
| N | D | D | P | P |
| N − 1 | D | P | D | P |
| Aspect 1 | N/A | K | E | N |
| Aspect 2 | N/A | N | R | N |
| Aspect 3 | DM | PM→DM | DM→PM | PM |
| Aspect 4 | 0 | 24 | 24 | 24 |

The decoding system's behaviour described by Table 2 may be controlled by a controller 170 communicatively connected to and controlling the spatial synthesis stage 150 and the mixer 130.

Figure 6:
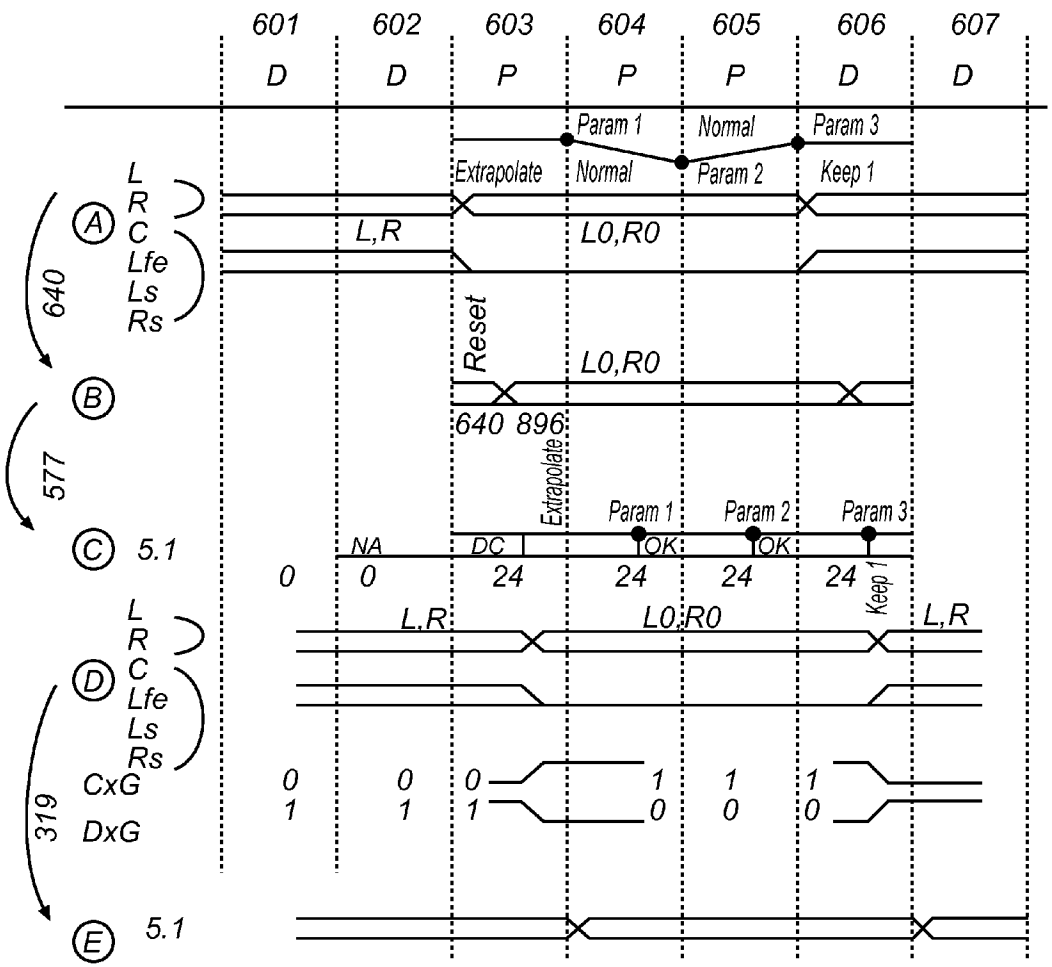
FIG. 6 illustrates data signals and control signals arising in an example decoding system equipped with the spatial synthesis stage of FIG. 5.

FIG. 6 illustrates data signals and control signals arising in an example decoding system 100 when the decoding system 100 receives an example input signal. FIG. 6 is divided into seven time frames 601 through 607, for which the coding regime is indicated below each reference number (discrete: D; parametric: P, like in the top portion of Table 2). The symbols Param1, Param2, Param3 refer to explicit mixing parameter values and their respective anchor points, which in this example embodiment is the right endpoint of a time frame.

The data signals originate from the locations indicated by encircled letters A through E in FIG. 1. The input signal A may in discrete coding regime be a representation of the audio signal as 5.1 surround with channels L (left), R (right) in an upper portion and C (center), Lfe (low frequency effects), Ls (left surround), Rs (right surround) in a lower portion. In parametric coding regime, however, the L and R channels are used to transmit core signal channels L0 (core left) and R0 (core right). Channels C, Lfe, Ls and Rs are present but not occupied in the parametric coding regime, so that the signal is formally in 5.1 format. Signal A may be supplied by the audio decoder 110. Signal B is a frequency-domain representation of the core signal, which is output by the first transform stage 151 in parametric mode but is preferably not generated in discrete mode to save processing resources. Signal C (not to be confused with the centre channel in signal A) is an upmixed signal received from the spatial synthesis stage 150 in parametric mode. Signal D is a delayed version of the input signal A, wherein the channels have been grouped as for signal A, and wherein the delay matches the pass-through time in the upper processing path in FIG. 1, the one including the spatial synthesis stage 150. Signal E is a delayed version of the mixer 130 output. Furthermore, FIG. 6 semi-graphically indicates the time values of control signals relating to the gain C×G applied to signal C by the mixer 130 and the gain D×G applied to signal D by the mixer 130; clearly, the gains assume values in the interval [0,1], and there are cross-mixing transitions during frame 603 and from frame 606. FIG. 6 is abstract in that it shows signal types (or signal regimes) while leaving signal values, primarily values of data signals, implicit or merely suggested.

FIG. 6 is annotated with the delays that separate the signals, in the form of curved arrows on the left side.

The different modes of operation listed in Tables 1 and 2 will now be described with reference to FIG. 6.

When the input signal is discretely coded in a current time frame 602 and a previous time frame 601 (first column of Table 2), the decoding system 100 is in a discrete mode (aspect 3: DM). The spatial synthesis stage 150 and mixing parameters are not needed (aspects 1 and 2: not applicable). Mixing parameters are not used in any portion of the present time frame 602 (aspect 4: 0). As shown in FIG. 6, the input signal A is a representation of the audio signal as 5.1 surround sound. The mixer 130 receives a delayed version D of the input signal and outputs this as the output E of the decoding system 100, possibly delayed by a second delay line 160 further downstream, as previously described with reference to FIG. 1.

When the input signal is discretely coded in a current time frame 606 and parametrically coded in a previous time frame 605 (second column of Table 2), the decoding system 100 transitions from a parametric mode to a discrete mode (aspect 3: PM→DM). Again, by virtue of the downmix stage 140 properties, which are controllable by the downmix specification, it is possible at all times across the parametric-to-discrete mode transition to obtain a stable core signal, and the mode transition can be carried out in a near unnoticeable fashion. The spatial synthesis stage 150 has received mixing parameters associated with the previous time frame. These are kept (aspect 1: K) during the current time frame, since there may be no new mixing parameters received that could serve as a second reference value for inter-frame interpolation. The spatial synthesis stage 150 receives a signal which transitions from being the core signal, of a parametrically coded signal received by the encoding system 100 as input signal A, to being a downmix signal of the discretely coded input signal A. The spatial synthesis stage 150 continues normal operation (aspect 2: N) from the previous time frame 605 during the current time frame 606. The mixing parameters are used during the whole time frame (aspect 4: 24). During the current time frame 606, the mixer 130 transitions from outputting the upmixed signal C received from the spatial analysis stage 150 to outputting the delayed version D of the input signal. As a consequence, the output E of the decoding system 100 transitions (during the next time frame 607 because of a delay of 319 samples incurred by the second delay line 160) from a reconstructed version, created by parametrically upmixing a downmixed signal, of the audio signal to a true multichannel signal representing the audio signal by n discretely encoded channels.

When the input signal is parametrically coded in a current time frame 603 and discretely coded in a previous time frame 602 (third column in Table 2), the decoding system 100 transitions from a discrete mode to a parametric mode (aspect 3: DM→PM). As this time frame 603 illustrates, even if there is in principle no coexistence of the core signal and the discretely coded channels, any discontinuities in connection with the regime change (between parametric and discrete coding) in the input signal are mitigated or avoided altogether, because the system has access to a stable core signal across the transition. The spatial synthesis stage 150 receives mixing parameters associated with the current time frame 603 at the end of the frame. Since there are no mixing parameters available for the previous time frame 602, the new parameters are extrapolated backward (aspect 1: E) to the entire current time frame 603 and used by the spatial synthesis stage 150. Since the spatial synthesis stage 150 has not been active in the previous time frame 602, it starts the current time frame 603 by resetting (aspect 2: R). The mixing parameters are used during the whole time frame (aspect 4: 24). The portion denoted "DC" (don't care) of signal C does not contribute to the output since the gain C×G is zero; the portion denoted "Extrapolate" is generated in the spatial synthesis stage 150 using extrapolated mixing parameter values; the portions denoted "OK" are generated in the normal fashion, using momentary mixing parameters that have been obtained by inter-frame interpolation between explicit values; and the portion "Keep1" is generated by maintaining the latest explicit mixing parameter value (from the latest parametrically coded time frame 605) and letting it control the quantitative properties of the spatial synthesis stage 150. Time frame 603 is but one example where such extrapolation occurs. Hence, during the current time frame 603, the mixer 130 transitions from outputting the delayed version C of the input signal to outputting the upmixed signal C received from the spatial analysis stage 150. As a consequence, the output E of the decoding system 100 transitions (during the next time frame 604 because of a delay of 319 samples incurred by the second delay line 160) from a true multichannel signal representing the audio signal by n discretely encoded channels to a reconstructed version, created by upmixing a downmixed signal, of the audio signal.

When the input signal is parametrically coded in a current time frame 605 and a previous time frame 604 (fourth column of Table 2), the decoding system is in a parametric mode (aspect 3: PM). The spatial synthesis stage 150 has received values, associated with the previous time frame, of the mixing parameters and also receives values, associated with the current time frame, of the mixing parameters, enabling normal frame-wise interpolation which provides the momentary mixing parameter values that control, inter alia, the gains applied during upmixing. This concludes the discussion relating to FIGS. 5 and 6 and Tables 1 and 2.

Figure 7:
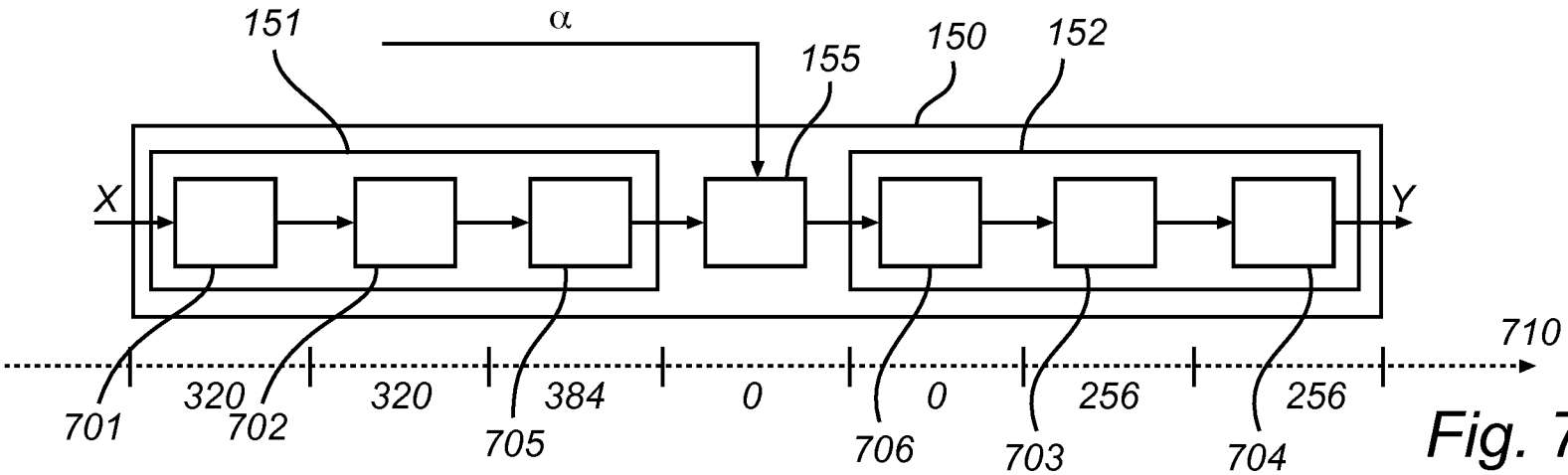
FIG. 7 shows details of a spatial synthesis stage according to an example embodiment for deployment in a decoding system.

Referring now to FIG. 7, there is shown a detail of a decoding system 100 having a hybrid filterbank, in accordance with a further example embodiment. In some applications, the increased resolution of the hybrid filter bank may be beneficial. According to FIG. 7, the first transform stage 151 in the spatial synthesis stage 150 comprises a time-to-frequency transform unit 701 (such as a QMF filter bank) followed by a real-to-complex conversion unit 702 and a hybrid analysis unit 705. Downstream of the first transform stage 151, there is an upmix stage 155 followed by the second transform stage 152, which comprises a hybrid synthesis unit 706, a complex-to-real conversion unit 703 and a frequency-to-time transform unit 704 arranged in this sequence. The respective pass-through times (in samples) are indicated below the dashed line 710; pass-through time zero is to be understood as sample-wise processing, wherein the algorithmic delay is zero and the actual pass-through time can be made arbitrarily low by allocating sufficient computational power. The presence of the hybrid analysis and synthesis stages 705, 706 constitutes a significant difference in relation to the previous example embodiment. The resolution is higher in the present embodiment, but the delay is longer and a controller 170 (or finite state machine) needs to handle a more complicated state structure (as shown below in Table 4) if it is to control the encoding system 100. As Table 3 indicates, the available operational modes of these units are similar to the previous case:

TABLE 3

| Available modes of operation, FIG. 7 | |
|---|---|
| Aspect 1 | E (extrapolate), N (normal), K (keep) |
| Aspect 2 | R (reset), N (normal) |
| Aspect 3 | PM (parametric), PM→DM, DM (discrete), DM→PM |
| Aspect 4 | 0 (none), 4 (flush), 24 (full) |

Reference is made to Table 1 and the subsequent discussion for further explanations. The new flush mode (in aspect 4) enables a time-domain cross fade from parametric n-channel output to discrete n-channel output.

As shown in below Table 4, a decoding system 100 according to the present example embodiment is controllable by a controller 170 (or finite state machine), the state of which is determined by the combination of the coding regimes (discrete or parametric) in the two time frames received before a current time frame. Using the same notation as in Table 2, the controller (or finite state machine) may be programmed as follows:

TABLE 4

FSM programming/Received time frame combinations vs. combinations of modes of operation

| Time frame | Coding regimes in the time frames N, N − 1 and N − 2 | | | | | | | |
|---|---|---|---|---|---|---|---|---|
| N | D | D | D | D | P | P | P | P |
| N − 1 | D | D | P | P | D | D | P | P |
| N − 2 | D | P | D | P | D | P | D | P |
| Aspect 1 | N/A | K | K | K | E | E | N | N |
| Aspect 2 | N/A | N | N | N | R | N | N | N |
| Aspect 3 | DM | PM→DM | DM→PM | PM | DM | PM→DM | DM→PM | PM |
| Aspect 4 | 0 | 4 | 24 | 24 | 24 | 24 | 24 | 24 |

Figure 8:
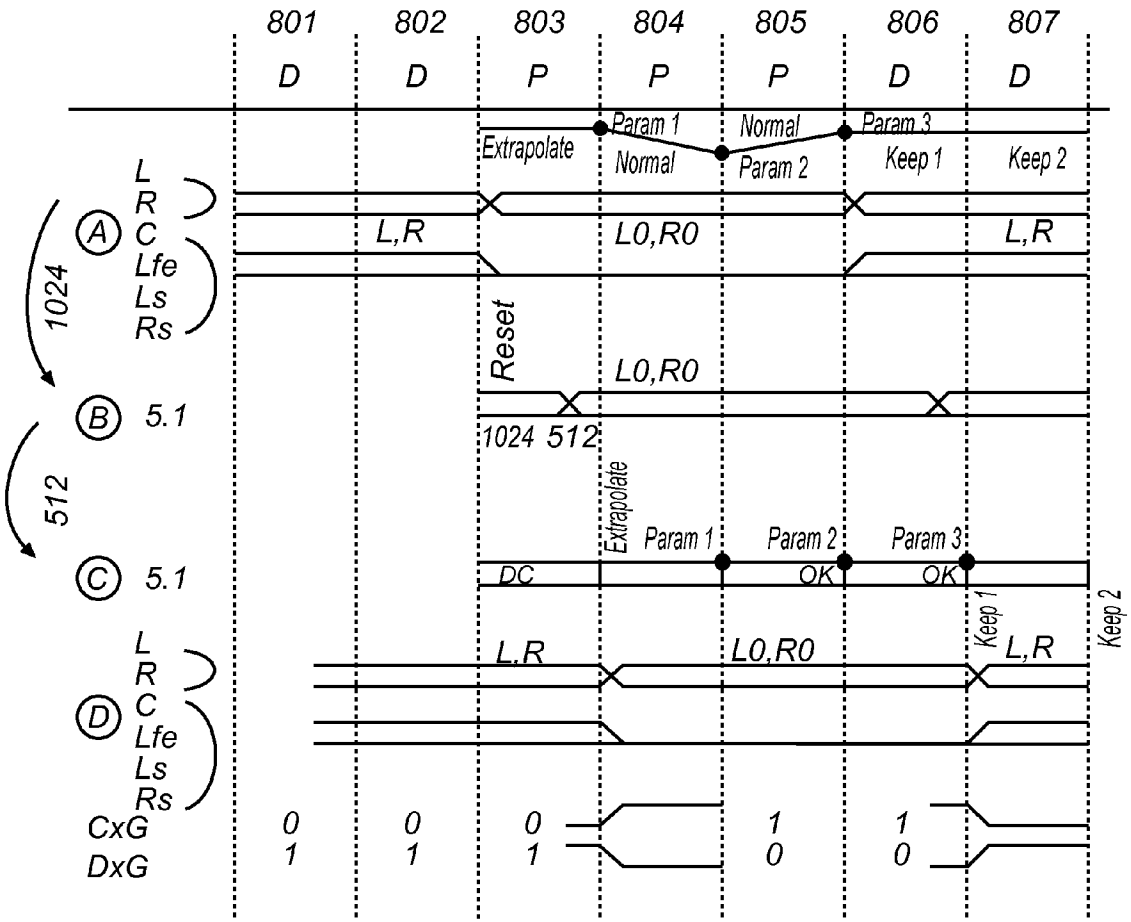
FIG. 8 illustrates data signals and control signals arising in an example decoding system equipped with the spatial synthesis stage of FIG. 7.

The application of the programming scheme in Table 4 is illustrated by FIG. 8, which visualizes data signals A through D, to be observed at the locations indicated by encircled letters A through D in FIG. 1, as functions of time over seven consecutive time frames 801 to 807.

The above discussion relating to the discrete decoding mode, the parametric decoding mode and the discrete-to-parametric transition illustrated in FIG. 6 applies, with appropriate adjustments, to the situation illustrated in FIG. 8 as well. One notable difference is due to the greater algorithmic delay in the parametric decoding computations in the present embodiment (1536 samples rather than 1217 samples). In decoding systems having an algorithmic delay of more than 1536 samples, a parametric-to-discrete transition may occupy one additional time frame. Hence, in order to provide the signal C for (a fraction of) a further time frame, the latest received explicit mixing parameter value may need to be forward extrapolated over two time frames, as suggested by "Keep1", "Keep2", so that cross fade may take place. In conclusion, still with reference to a decoding system where the algorithmic delay exceeds 1536 samples or an entire frame, the transition from parametric to discrete decoding mode is triggered by a coding regime change in the input signal from a parametric episode to a discrete episode, wherein the latest explicit mixing parameter value is forward extrapolated (kept) up to the end of two time frames after the associated time frame, wherein the decoding system enters discrete mode in the second time frame after the first received discretely coded time frame.

There will now be described a decoding system having a spatial synthesis stage with the general structure as in FIG. 5 (and consequently, the same algorithmic delay values as indicated in FIG. 6) but with the ability to process an input signal which is in a reduced parametric regime. The properties of the reduced parametric coding regime have been outlined above, including its differences with respect to the parametric and discrete coding regimes.

Figure 11:
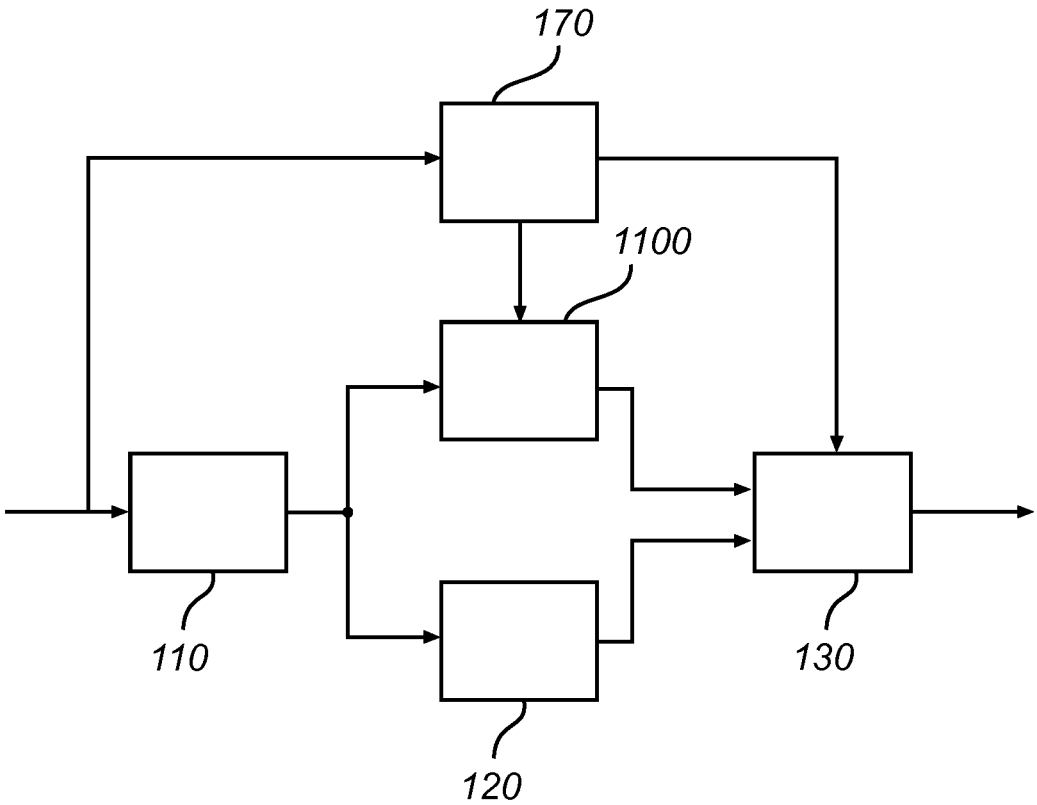
FIG. 11 is a generalized block diagram of a decoding system in accordance with an example embodiment of the invention.

In the decoding system to be considered here, there is provided a controller 170 with the additional responsibility of controlling the operation of the downmix stage 140. In FIG. 1, this is suggested by the dashed arrow from the controller 170 to the downmix stage 140. The present decoding system may be said to be organized according to the functional structure shown in FIG. 11, wherein an input signal to the system is supplied to both the audio decoder 110 and the controller 170. The controller 170 is configured to control, based on the detected coding regime of the input signal, each of the mixer 130 and a parametric multi-channel decoder 1100, in which the downmix stage (not shown in FIG. 11) and the spatial synthesis stage (not shown in FIG. 11) are comprised. The mixer 130 receives input from the parametric multichannel decoder 1100 and from the first delay line 120, each of which base their processing on data extracted by the audio decoder 110 from the input signal. In order for the decoding system to benefit from the reduced parametric coding regime, the controller 170 is operable to deactivate the downmix stage in the parametric multichannel decoder 1100. Preferably, the downmix stage is deactivated when the input signal is in the reduced parametric regime, when the core signal to be supplied to the spatial synthesis stage is represented in m-channel format (rather than n-channel format, as in the regular parametric mode). Even if, as noted, those signals in the n-channel format which represent the core signal pass through the downmix stage unchanged, the fact that the core signal can be supplied directly to the spatial synthesis stage without any need for conversion between n-channel format and m-channel format implies a potential saving in computational resources.

Because the controller 170 is also adapted to control the downmix stage 140, the table of available modes in the decoding system is extended with respect to Table 1 above:

TABLE 5

Figure 10:
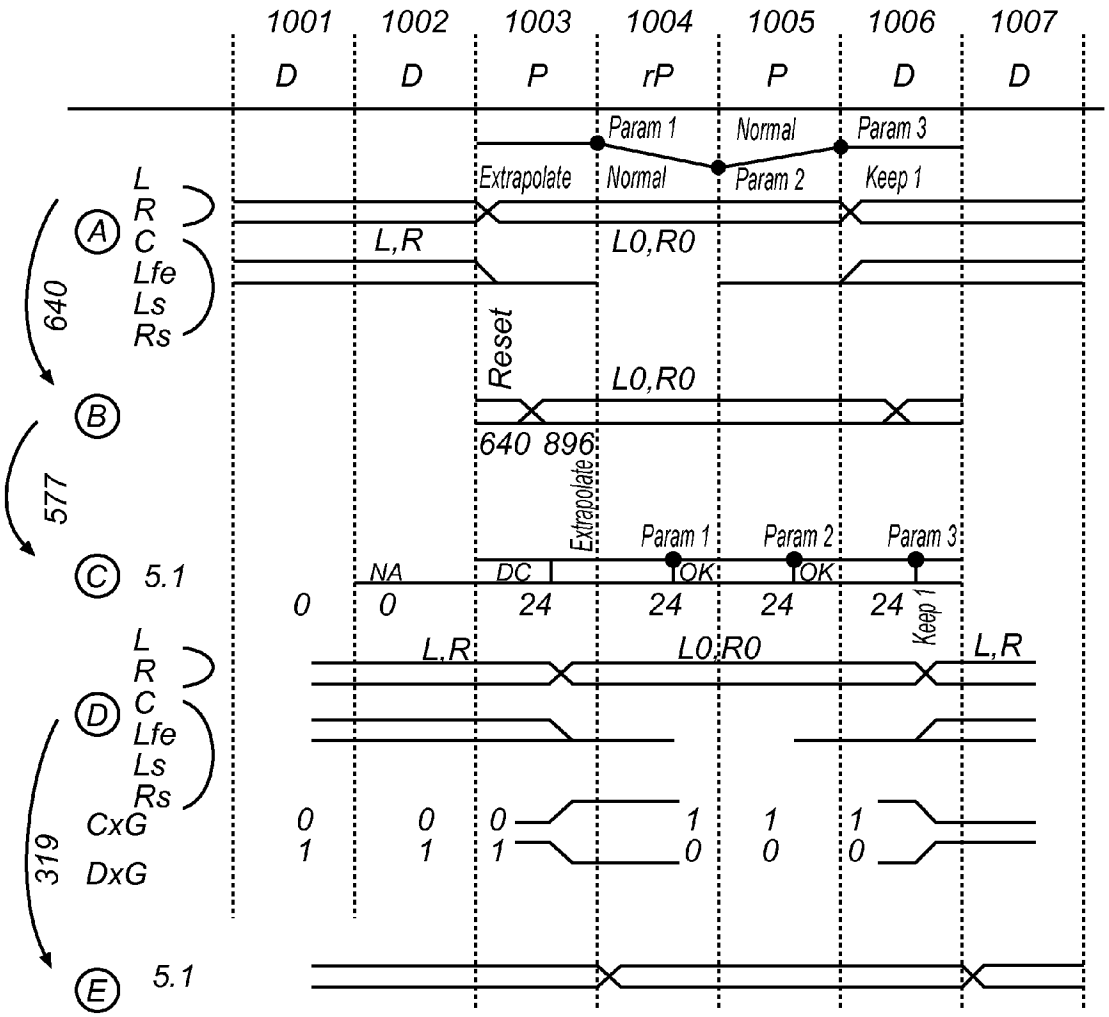
FIG. 10 illustrates data signals and control signals arising in an example decoding system equipped with the spatial synthesis stage of FIG. 5.

| Available modes of operation, FIG. 10 | |
|---|---|
| Aspect 1 | E (extrapolate), N (normal), K (keep) |
| Aspect 2 | R (reset), N (normal), NDB (normal, downmix bypassed) |
| Aspect 3 | PM (Parametric), PM→DM, DM (Discrete), DM→PM |
| Aspect 4 | 0 (none), 24 (full) |

The R (reset) and N (normal) modes under aspect 2 are as previously defined. In the new NDB (normal, downmix bypassed) mode, the downmix stage 140 is deactivated, and the core signal is supplied to the spatial synthesis stage 150 without a format conversion involving a change in the number of channels.

The state of the controller 170 is still uniquely determined by the combination of the coding regimes in the current and the previous time frame. The presence of the new coding regime increases the size of the FSM programming table in comparison with Table 2:

TABLE 6

FSM programming/Received time frame combinations vs. combinations of modes of operation

| Time frame | Coding regimes in time frames N and N − 1 | | | | | | |
|---|---|---|---|---|---|---|---|
| N | D | D | P | P | P | rP | rP |
| N − 1 | D | P | D | P | rP | rP | P |
| Aspect 1 | N/A | K | E | N | N | N | N |
| Aspect 2 | N/A | N | R | N | N | NDB | NDB |
| Aspect 3 | DM | PM→DM | DM→PM | PM | PM | PM | PM |
| Aspect 4 | 0 | 24 | 24 | 24 | 24 | 24 | 24 |

Table 6 does not treat the two cases (D, rP) and (rP, D), which are not expected to occur except in a failure state of the system according to this example embodiment. Some implementations may further exclude the case (P, P) referred to in the $4^{th}$ column (or regard this case as a failure) since it may be more economical to have the input signal switch to rP regime as soon as possible. However, if the encoder is configured for very fast switching, two discretely coded episodes may be separated by a very small number of time frames belonging to the other coding regimes, and it may turn out necessary to accept (P, P) as a normal case. Put differently, very short parametric episodes may be occupied by the portions necessary to achieve smooth switching to the extent that the encoding system does not have time to enter a reduced parametric encoding mode.

With reference to FIG. 10, the decoding system is in the mode corresponding to the $1^{st}$ or $2^{nd}$ column of Table 6 in time frame 1001; it is in the mode corresponding to the $1^{st}$ column in time frame 1002; it is in the mode corresponding to the $3^{rd}$ column in time frame 1003; it is in the mode corresponding to the $7^{th}$ column in time frame 1004; it is in the mode corresponding to the $5^{th}$ column in time frame 1005; it is in the mode corresponding to the $2^{nd}$ column in time frame 1006; and it is in the mode corresponding to the $1^{st}$ column in time frame 1007. In this example, time frame 1004 is the only time frame in which the received input signal is in the reduced parametric regime. In a more realistic example, however, an episode of time frames in reduced parametric coding regime is typically longer, occupying a larger number of time frames than the parametrically coded time frames at its endpoints, which are relatively fewer. A more realistic example of this type will illustrate the mode which the decoding system enters in response to receipt of two consecutive rP, rP coded time frames, corresponding to the $6^{th}$ column of Table 6. However, since the $6^{th}$ and $7^{th}$ columns in the table do not differ as far as aspects 1-4 are concerned, it is believed that the skilled person will be able to understand and implement the desirable behaviour of the decoding system in such a time frame by studying FIG. 10 and the above discussion.

It is noted in closing that Tables 5-6 and FIG. 10 could have been derived equally well with Tables 3-4 and FIGS. 7-8 as a starting point. Indeed, while the decoding system illustrated therein is associated with a greater algorithmic delay, the ability of receiving and processing an input signal in reduced parametric coding regime may be implemented substantially in the same manner as described above. If the algorithmic delay exceeds one time frame, however, the state of the controller 170 in the decoding system will be determined by the coding regime in the current time frame and two previous time frames. The total number of possible controller states will be $3^3=27$, but a substantial number of out these (including any three-frame sequence including (rP, D) or (D, rP)) may be left out of consideration since they will only appear as a consequence of an encoder-side failure. It is emphasized that the last statement applies primarily to the example embodiment described hereinabove and does not relate to an essential limitation of the invention as such. Indeed, an embodiment capable of reconstructing an audio signal based on an arbitrary sequence of reduced parametrically and discretely (and possibly also parametrically) time frame will be discussed below after the description of FIG. 12.

Figure 12:
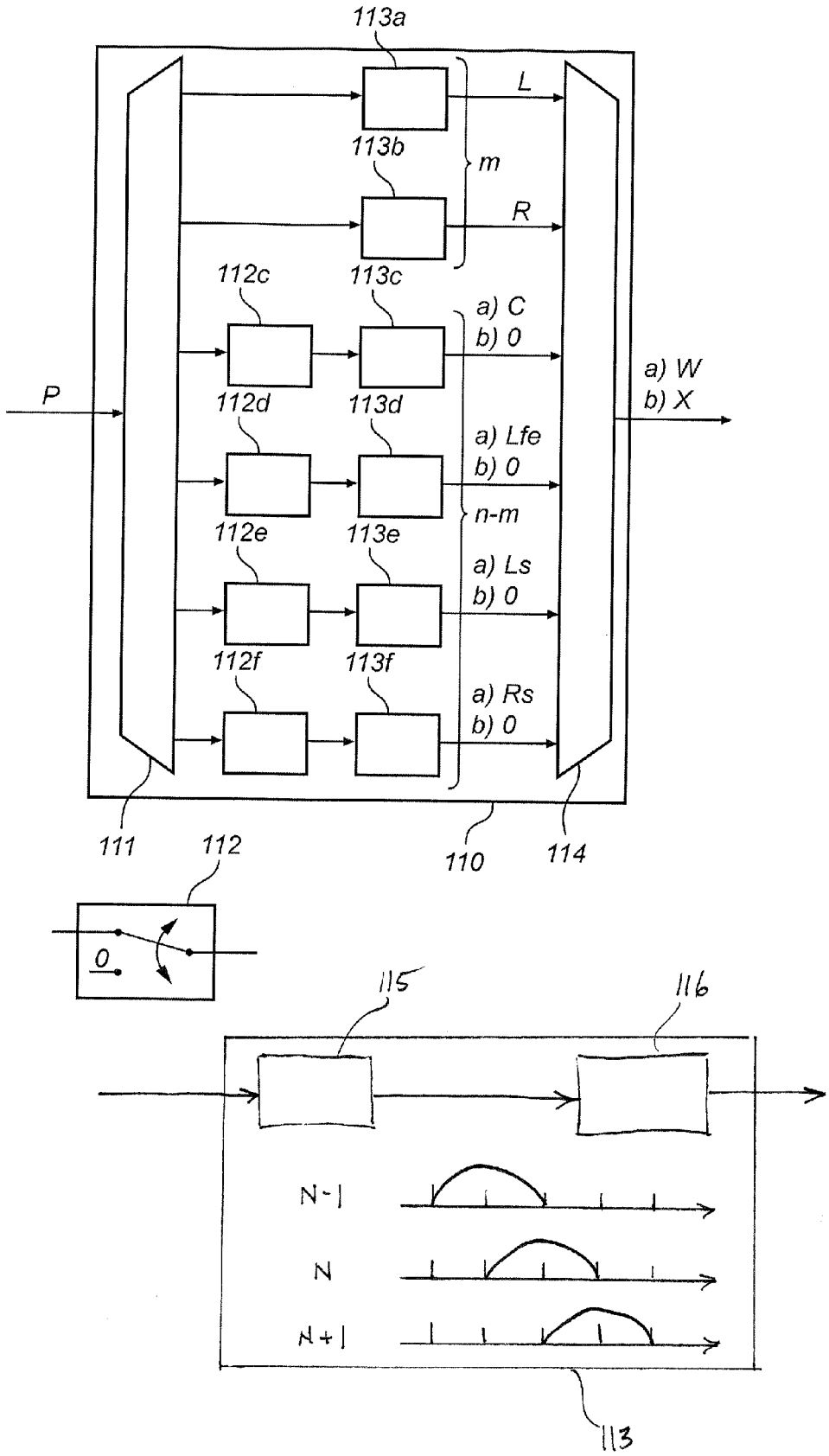
FIG. 12 shows details of an audio decoder according to an example embodiment for deployment in a decoding system.

FIG. 12 shows a possible implementation of the audio decoder 110 forming part of the decoding system 100 of FIG. 1 or similar decoding systems. The audio decoder 110 is adapted to output a time-domain representation of an input signal W, X on the basis of an incoming bitstream P. For this purpose, a demultiplexer 111 extracts channel substreams (each which may be regarded as a frequency-domain representation of a channel in the input signal) from the bitstream P which are associated with each of the channels in the input signal W, X. The respective channel substreams are supplied, possibly after additional processing, to a plurality of channel decoders 113, which provide each of the channels L, R, . . . of the input signal. Each of the channel decoders 113 preferably provides a time value of the associated channel by summing contributions from at least two windows which overlap at the current point in time. This is the case of many Fourier-related transforms, in particular MDCT; for example, one transform window may be equivalent to 512 samples. The inner workings of a channel decoder 113 are suggested in the lower portion of the drawing: it comprises an inverse transform section 115 followed by an overlap-add section 116. In some implementations, the inverse transform section 115 may be configured to carry out an inverse MDCT. The three plots labelled N−1, N and N+1 visualize the output signal from the inverse transform section 115 for three consecutive transform windows. In the time period where the $(N-1)^{th}$ and $N^{th}$ transform windows overlap, the overlap-and-add section 116 forms the time values of the channel by adding the inversely transformed values within the $(N-1)^{th}$ and $N^{th}$ transform windows. In the subsequent time period, similarly, the time values of the channel signal are obtained by adding the inversely transformed values pertaining to the $N^{th}$ and $(N+1)^{th}$ transform windows. Clearly, the $(N-1)^{th}$ and $N^{th}$ transform windows will originate from different time frames of the input signal in the vicinity of a time frame border. Returning to the main portion of FIG. 12, a combining unit 114 located downstream of the channel decoders 113 combines the channels in a manner suitable for the subsequent processing, e.g., by forming time frames each of which includes the necessary data for reconstructing all channels in that time frame.

As stated, the audio signal may be represented either (b) by parametric coding or (a) as n discretely encoded channels W (n>m). In parametric coding, while m signals are used to represent the audio signal, an n-channel format is used, so that n−m signals do not carry information or may be assigned neutral values, as explained above. In example implementations, this may imply that n−m of said channel substreams represent a neutral signal value. The fact that neutral signal values are received in the not-used channels is beneficial in connection with a coding regime change from parametric to discrete coding or vice versa. In the vicinity of such a coding regime change, two transform windows belonging to frames with different coding regimes will overlap and contribute to the time-representation of the channel. By virtue of the presence of the neutral values, however, the operation of summing the contributions will still be well-defined.

In some example embodiments, the decoding system 100 is further adapted to receive time frames of the input signal that are (c) reduced parametrically coded, wherein the input signal is in m-channel format. This means the n−m channels that carry neutral values in the parametric coding regime are altogether absent. To ensure smooth functioning of the channel decoders 113 also across a coding regime change, at least n−m of the channel decoders 113 are preceded by a pre-processor 112 which is shown in detail in the lower portion of FIG. 12. The pre-processor 112 is operable to produce a channel substream encoding neutral values (denoted "0"), which has been symbolically indicated by a selector switchable between a pass-through mode and a mode where the neutral value is output. The corresponding channel of the input signal W, X will contain neutral values on at least one side of the coding regime change.

The pre-processors 112 may be controllable by a controller 170 in the decoding system 100. For instance, they may be activated in such regime changes between (b) discrete coding and (c) reduced parametric coding where there is no intermediate parametrically coded time frame. Because the input signal W, X will be supplied to the downmix stage 140 in time frames which are adjacent to a discrete episode, it is necessary in such circumstances that the input signal be sufficiently stable. To achieve this, the controller 170 will respond to a detected regime change of this type by activating the pre-processors 112 and the downmix stage 140. The collective action of the pre-processors 112 is to append n−m channels to the input signal. From an abstract point of view, the pre-processors 112 achieve a format conversion from an m-channel format into an n-channel format (e.g., from acmod2 into acmod7 in the Dolby Digital Plus framework).

The audio decoder 110 which has been described above with reference to FIG. 12 makes it possible to supply a stable input signal—and hence a stable downmix signal—also across regime changes from reduced parametric coding into discrete coding and vice versa. Indeed, the decoding systems details of which are depicted in FIGS. 5 and 7 may be equipped with an audio decoder with the above characteristics. These systems will then be able to handle a time frame sequence of the type D D D rP rP . . . rP D D D by operating in accordance with FIGS. 6 and 8, respectively.

Turning to FIG. 6 specifically, the coding regime of time frames 603, 604 and 605 will be reduced parametric (rP). In time frame 603, the at least one pre-processor 112 in the audio decoder 110 is activated in order to reformat the signal into n-channel format, so that the downmix stage 140 will operate across the regime change (from L, R into L0, R0) without interruption. Preferably, the pre-processor is active only during an initial portion of the time frame 603, corresponding to the time interval where transform windows belonging to different coding regimes are expected to overlap. In time frame 604, the reformatting is not necessary, but the input signal A may be forwarded directly to the input side of the spatial synthesis stage 151 and the downmix stage 140 can be deactivated temporarily. However, because time frame 605 is the last one in the reduced parametric episode and contains at least one transform window having its second endpoint in the next frame, the audio decoder 110 is set in reformatting mode (pre-processors 112 active). In time frame 606 then, when the downmix stage 140 is activated, the change in content of the input signal A at the beginning of this time frame 606 will not be noticeable to the downmix stage 140 which will instead provide a discontinuous downmix signal X across the content change. Again, it is sufficient and indeed preferable for the pre-processors 112 to be active only during the last portion of time frame 605, in which is located the beginning of the transform window which will overlap with the first transform window of the first discretely coded time frame 606.

A similar variation of FIG. 8 is possible as well, wherein reduced parametrically coded data (rP) are received during time frames 803, 804 and 805. Suitably, and for the reasons noted in the previous paragraph and elsewhere, the format conversion functionality of the audio decoder 110 is active in (the beginning of) time frame 803 and (the end of) time frame 805, so that the decoder may supply a homogenous and stable signal to the downmix stage 140 at all times across the two regime changes. It is recalled that this example embodiment comprises a hybrid filterbank, but this fact is of no particular relevance to the operation of the audio decoder 110. Unlike e.g. the period during which the mixing parameters a need to be extrapolated, the duration of the potential signal discontinuity arising from the change in signal content is independent of the algorithmic delays in the system and remains localized in time on its way through the system. In other words, there is no need to operate the pre-processors 112 for longer periods of time in the example embodiment shown in FIG. 8 compared to FIG. 6.

IV. Example Embodiments

Error Handling

In an example embodiment, a decoding system, which is structurally similar or identical with one of the decoding systems described above or in any of the figures, comprises a controller executing instructions in accordance with Table 7 below.

TABLE 7

| Selection of a mode of the decoding system | | | | | |
|---|---|---|---|---|---|
| | | CODING REGIME OF CURRENT FRAME | | | |
| | | No metadata or Discrete | Parametric P(P) | Parametric P(I) | Defective |
| CURRENT MODE | Discrete mode, previous was not Defective | Discrete | Use core signal (F) | Transition into Parametric | Discrete |
| | Parametric mode | Transition into Discrete | Parametric | Parametric | Keep (A) |

TABLE 7-continued

| Selection of a mode of the decoding system | | | | |
|---|---|---|---|---|
| | CODING REGIME OF CURRENT FRAME | | | |
| | No metadata or Discrete | Parametric P(P) | Parametric P(I) | Defective |
| Discrete mode, previous was Defective | Discrete | Use core signal (F) | Parametric | Discrete |
| Keep mode | Transition into Discrete (G) | Keep (E) | Parametric (D) | Keep (B) |

Table 7 indicates the mode to be selected for a given combination of a current mode of the decoding system, a current received frame and in some cases the coding regime of the previous received frame as well. The letters A-G refer to the instructions discussed in the Overview subsection. Table 7 covers the case where the metadata (including the mixing parameter(s)) are encoded predictively in the parametric regime, wherein P(P) refers to a parametric P-frame and P(I) refers to a parametric I-frame. Table 7 also covers the case where each parametrically coded frame is decodable independently of other frames; then there will not be any parametric P-frames and the column "Parametric (P)" will not be relevant.

In addition to the instructions in Table 7, the controller may alternatively be configured with instruction C, which specifies an upper limit on the number of consecutive time frames to be decoded in Keep mode. If the upper limit is exceeded, the decoding system enters the discrete mode. Hence, possible controller configurations may include the instruction set {A, B, D, E, F, G} and the instruction set {A, C, D, E, F, G}. Using a controller configured with an instruction set that simultaneously includes instructions B and C is currently not preferred.

Figure 13:
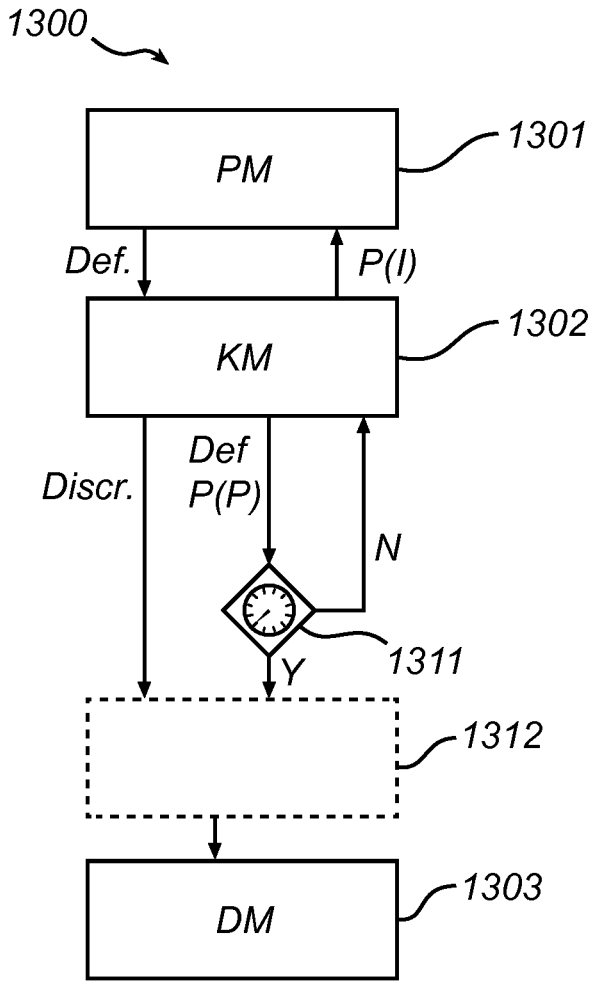
FIG. 13 is a partial state diagram showing some of the possible modes in which a decoding system according to an example embodiment of the invention operates, and some of the possible transitions between the modes.

FIG. 13 shows the behaviour of the decoding system as a state diagram 1300. The parametric mode (PM), the keep mode (KM) and the discrete mode (DM) of the decoder system are represented by large rectangles 1301, 1302, 1303. The arrows ending in any of the large rectangles 1301, 1302, 1303 represent momentary mode changes. The two arrows ending in the DM are however preceded by a mode transition 1312 occupying non-zero time, as discussed previously.

As outlined above, the frames of the input signal may comprise a data portion carrying the core signal (m channels) or the n discretely encoded channels and including a metadata container with metadata, such as a first flag indicating whether the frame belongs to the discrete or parametric regime, a second flag indicating that an error has occurred upstream of the decoding system, and, if applicable, one or more mixing parameters for guiding spatial synthesis in the parametric mode of the decoding system. It is recalled that a defective frame may be one for which the second flag indicates an error or a frame which the decoding system is not able to decode successfully (as indicated, e.g., by a CRC test). The data portion, with the exception of the metadata container, may be encoded in a legacy-type format, for which decoders are available which include independent error handling functionalities, including error discovery and error concealment schemes. As such, the controller may be configured not to verify the correctness of the data portion, but instead pass this on to a core decoder immediately after removal of the metadata container. The core decoder will provide the m-channel core signal or said n channels on a best-effort basis and supply this to the downstream components of the decoding system. As such, without the controller's explicit knowledge, it may well be that the spatial synthesis stage uses a restored core signal rather than a successfully decoded core signal. This architecture, which realizes a distribution of tasks between the controller and the decoder, is likely to increase the robustness of the decoding system, so that it may provide sensible audio output also on the basis of a heavily distorted input signal.

Starting from the PM, receipt of a defective frame of the input signal may trigger the decoding system to change into the KM (instruction A). Several different outcomes are possible from the KM: if a discretely coded frame is received, the decoding system performs a mode transition into the DM (instruction G); otherwise, if a parametrically coded frame with decodable metadata (such as a parametric I-frame) is received, the decoding system changes into parametric mode (instruction D); otherwise, if a parametric P-frame or a further defective frame is received, it is ascertained at counter 1311 whether or not the duration in the keep mode is about to exceed the predetermined maximum duration, after which the decoding system goes into the DM or the KM, as the case may be (instructions B, C, E).

It is noted that FIG. 13 is a partial view in which, for the sake of simplicity, only a subset of the events made possible by the instructions in table 7 have been indicated. For instance, no mode changes away from the discrete mode have been drawn. Furthermore, FIG. 13 does not show the operational mode in which the core signal is decoded and output (possibly after an additional processing step involving an increase of the channel number). It is considered to lie within the abilities of the skilled person studying this disclosure to carry out any necessary completions to FIG. 13 with the aid of table 7.

V. Equivalents, Extensions, Alternatives and Miscellaneous

Further embodiments of the present invention will become apparent to a person skilled in the art after studying the description above. Even though the present description and drawings disclose embodiments and examples, the invention is not restricted to these specific examples. Numerous modifications and variations can be made without departing from the scope of the present invention, which is defined by the accompanying claims. Any reference signs appearing in the claims are not to be understood as limiting their scope.

The systems and methods disclosed hereinabove may be implemented as software, firmware, hardware or a combination thereof. In a hardware implementation, the division of tasks between functional units referred to in the above description does not necessarily correspond to the division into physical units; to the contrary, one physical component may have multiple functionalities, and one task may be carried out by several physical components in cooperation.

Certain components or all components may be implemented as software executed by a digital signal processor or microprocessor, or be implemented as hardware or as an application-specific integrated circuit. Such software may be distributed on computer readable media, which may comprise computer storage media (or non-transitory media) and communication media (or transitory media). As is well known to a person skilled in the art, the term computer storage media includes both volatile and nonvolatile, removable and non-removable media implemented in any method or technology for storage of information such as computer readable instructions, data structures, program modules or other data. Computer storage media includes, but is not limited to, RAM, ROM, EEPROM, flash memory or other memory technology, CD-ROM, digital versatile disks (DVD) or other optical disk storage, magnetic cassettes, magnetic tape, magnetic disk storage or other magnetic storage devices, or any other medium which can be used to store the desired information and which can be accessed by a computer. Further, it is well known to the skilled person that communication media typically embodies computer readable instructions, data structures, program modules or other data in a modulated data signal such as a carrier wave or other transport mechanism and includes any information delivery media.

The invention claimed is:

1. A decoding system (100) for reconstructing an n-channel audio signal, wherein the decoding system is adapted to receive an input signal segmented into time frames and representing the audio signal, in a given time frame, according to a coding regime selected from the group comprising:

parametric coding (P; P(I), P(P)), in which the input signal comprises m channels and at least one mixing parameter ($\alpha$), where $n>m\geq 1$; and discrete coding (D; Discr.), in which the input signal comprises the n channels discretely encoded, the decoding system being operable to derive the audio signal at least in a parametric mode (PM; 1301) of the decoding system, by spatial synthesis guided by said at least one mixing parameter from a current frame, and, in a discrete mode (DM; 1303) of the decoding system, on the basis of said n discretely encoded channels, the decoding system comprising a controller (170) for controlling the mode of the decoding system on the basis of at least a current mode of the decoding system and a current received frame of the input signal, such as by performing a mode transition into a mode corresponding to a coding regime of the current received frame, wherein the controller is configured to respond to receipt of a defective frame (Def.), when in the parametric mode, by entering a keep mode (KM; 1302), in which the decoding system derives the audio signal by spatial synthesis taking as input m channels from the defective frame and being guided by at least one mixing parameter from a previous frame, wherein the decoding system (100) is adapted to receive the input signal representing the audio signal according to parametric coding by either an independent frame (P(I)) or a predicted frame (P(P)), wherein said at least one mixing parameter in a current predicted frame is decodable only after decoding a preceding independent frame, wherein the controller is further configured to respond to receipt of a predicted frame, when in the keep mode, by remaining in the keep mode.

2. The decoding system of claim 1, wherein the controller is further configured to respond to receipt of a defective frame, when in the keep mode, by remaining in the keep mode, wherein the controller includes a keep mode counter (1311) causing the controller to respond to receipt of a defective frame, when having remained in the keep mode for a predetermined maximum duration, by entering the discrete mode and otherwise by remaining in the keep mode.

3. The decoding system of claim 1, further comprising:

a downmix stage (140) operable to output an m-channel downmix signal (X) based on the input signal in accordance with a downmix specification, wherein $n>m\geq 1$; and a spatial synthesis stage (150) operable to output an n-channel representation (Y) of the audio signal based on said downmix signal and at least one mixing parameter ($\alpha$), wherein the spatial synthesis stage is configured to be active at least in the parametric mode and the keep mode of the decoding system, the decoding system further comprising:

a first delay line (120) adapted to receive the input signal; and a mixer (130) communicatively connected to the spatial synthesis stage and the first delay line and being adapted to output, in the parametric mode or keep mode of the system, the spatial synthesis stage output or a signal derived therefrom;

to output, in the discrete mode of the system, the first delay line output; and to output, during a mode transition between parametric and discrete coding, a mixing transition between the spatial synthesis stage output and the first delay line output.

4. A decoding system (100) for reconstructing an n-channel audio signal, wherein the decoding system is adapted to receive an input signal segmented into time frames and representing the audio signal, in a given time frame, according to a coding regime selected from the group comprising:

parametric coding (P; P(I), P(P)), in which the input signal comprises m channels and at least one mixing parameter ($\alpha$), where $n>m\geq 1$; and discrete coding (D; Discr.), in which the input signal comprises the n channels discretely encoded, the decoding system being operable to derive the audio signal at least in a parametric mode (PM; 1301) of the decoding system, by spatial synthesis guided by said at least one mixing parameter from a current frame, and, in a discrete mode (DM; 1303) of the decoding system, on the basis of said n discretely encoded channels, the decoding system comprising a controller (170) for controlling the mode of the decoding system on the basis of at least a current mode of the decoding system and a current received frame of the input signal, such as by performing a mode transition into a mode corresponding to a coding regime of the current received frame, wherein the controller is configured to respond to receipt of a defective frame (Def.), when in the parametric mode, by entering a keep mode (KM; 1302), in which the decoding system derives the audio signal by spatial synthesis taking as input m channels from the defective frame and being guided by at least one mixing parameter from a previous frame, wherein the decoding system (100) is adapted to receive the input signal representing the audio signal according to parametric coding by either an independent frame (P(I)) or a predicted frame (P(P)), wherein said at least one mixing parameter in a current predicted frame is decodable only after decoding a preceding independent frame, wherein the controller is further configured to respond to receipt of a predicted frame, when in the discrete coding mode, by deriving the audio signal on the basis of said m channels without guidance by a mixing parameter.

5. The decoding system of claim 4, wherein the controller is further configured to respond to receipt of a defective frame, when in the keep mode, by remaining in the keep mode, wherein the controller includes a keep mode counter (1311) causing the controller to respond to receipt of a defective frame, when having remained in the keep mode for a predetermined maximum duration, by entering the discrete mode and otherwise by remaining in the keep mode.

6. The decoding system of claim 4, further comprising:

a downmix stage (140) operable to output an m-channel downmix signal (X) based on the input signal in accordance with a downmix specification, wherein $n>m\geq 1$; and a spatial synthesis stage (150) operable to output an n-channel representation (Y) of the audio signal based on said downmix signal and at least one mixing parameter ($\alpha$), wherein the spatial synthesis stage is configured to be active at least in the parametric mode and the keep mode of the decoding system, the decoding system further comprising:

a first delay line (120) adapted to receive the input signal; and a mixer (130) communicatively connected to the spatial synthesis stage and the first delay line and being adapted to output, in the parametric mode or keep mode of the system, the spatial synthesis stage output or a signal derived therefrom;

to output, in the discrete mode of the system, the first delay line output; and to output, during a mode transition between parametric and discrete coding, a mixing transition between the spatial synthesis stage output and the first delay line output.

7. A decoding system (100) for reconstructing an audio signal having n components, wherein the decoding system is adapted to receive an input signal segmented into time frames and representing the audio signal, in a given time frame, according to a parametric coding regime comprising parametric coding (P; P(I)) in which the input signal comprises m components and at least one mixing parameter ($\alpha$), where $n>m\geq 1$, wherein the decoding system is configured to reconstruct the n components of the audio signal by an upmix operation based on said m components and said at least one mixing parameter from a current frame, the decoding system comprising a controller (170) for controlling a mode of the decoding system on the basis of at least a current mode of the decoding system and a current received frame of the input signal, wherein the controller is configured to respond to receipt of a defective frame (Def.) by entering a keep mode (KM; 1302) in which the decoding system reconstructs the n components of the audio signal by an upmix operation based on the m components of the input signal related to the defective frame and at least one mixing parameter related to a previous frame, wherein the controller includes a keep mode counter (1311) causing the controller to respond to receipt of a further defective frame, when having remained in the keep mode for a predetermined maximum duration, by entering a further mode and otherwise by remaining in the keep mode, wherein the further mode is a fallback mode including outputting the m components as a decoder output signal.

8. The decoding system according to claim 7, wherein the controller is further configured to resume operating in the parametric coding regime, when in the keep mode, upon receiving a frame in which said at least one mixing parameter is decodable.

* * * * *